US010280562B2

(12) United States Patent
Kotilainen et al.

(10) Patent No.: US 10,280,562 B2
(45) Date of Patent: May 7, 2019

(54) PROCESS TO MANUFACTURE LOW WEIGHT HIGH QUALITY PAPER FOR USE AS A SUPPORT LAYER OF A RELEASE LINER WITH A BELT ASSEMBLY

(71) Applicant: UPM Specialty Papers Oy, Helsinki (FI)

(72) Inventors: Jukka Kotilainen, Valkeakoski (FI); Jussi Leinonen, Valkeakoski (FI); Janne Antila, Hämeenlinna (FI); Jari Tamminen, Valkeakoski (FI)

(73) Assignee: UPM SPECIALTY PAPERS OY, Helsinki (FI)

( * ) Notice: Subject to any disclaimer, the term of this patent is extended or adjusted under 35 U.S.C. 154(b) by 0 days.

(21) Appl. No.: 15/510,843

(22) PCT Filed: Sep. 15, 2014

(86) PCT No.: PCT/FI2014/050702

§ 371 (c)(1),
(2) Date: Mar. 13, 2017

(87) PCT Pub. No.: WO2016/042198

PCT Pub. Date: Mar. 24, 2016

(65) Prior Publication Data

US 2017/0284024 A1 Oct. 5, 2017

(51) Int. Cl.
*D21F 2/00* (2006.01)
*D21F 3/04* (2006.01)
(Continued)

(52) U.S. Cl.
CPC ..... *D21F 3/04* (2013.01); *D21F 2/00* (2013.01); *D21F 5/00* (2013.01); *D21F 5/004* (2013.01);
(Continued)

(58) Field of Classification Search
CPC . D21F 3/04; D21F 3/045; D21F 5/004; D21F 3/00; D21H 27/001; D21H 19/10; D21H 23/56; D21G 1/00
See application file for complete search history.

(56) References Cited

U.S. PATENT DOCUMENTS 5,169,501 A * 12/1992 Meinecke ..... D21F 3/0218 162/290
5,240,563 A * 8/1993 Karvinen ..... D21F 7/001 162/274
(Continued)

FOREIGN PATENT DOCUMENTS

DE 102016209780 A1 * 12/2017 ..... D21F 1/32
EP 1279768 A3 * 5/2003 ..... D21H 19/84
(Continued)

OTHER PUBLICATIONS

Peel, John D., "Paper Science and Paper Manufacture," Angus Wilde Publications, Inc., p. 159. (Year: 1999).*
(Continued)

*Primary Examiner* — Jose A Fortuna
(74) *Attorney, Agent, or Firm* — Cantor Colburn LLP

(57) ABSTRACT

The invention relates to manufacturing low weight high quality paper suitable for use as a support layer of a release liner. A paper web is formed from pulp slurry, the moisture content of the paper web is reduced by a press section (PSEC), the paper web is supported by a belt (BELT1) from a first contact point (CP1) in the press section (PSEC) to a first separation point (SP1) in a drying section (DSEC), and the paper web is dried to form paper. The temperature profile of the paper web may be non-decreasing. When supported, the temperature of the paper web of the paper web may be higher than or equal to 56° C. to obtain a paper web having a dry content of at least 40 wt.-% at the first separation point.

20 Claims, 8 Drawing Sheets

(51) Int. Cl.

| | |
|---|---|
| ***D21F 5/00*** | (2006.01) |
| ***D21G 1/00*** | (2006.01) |
| ***D21F 11/00*** | (2006.01) |
| ***D21H 19/10*** | (2006.01) |
| ***D21H 25/04*** | (2006.01) |
| ***D21H 27/00*** | (2006.01) |

(52) U.S. Cl.
CPC ..... *D21F 11/00* (2013.01); *D21G 1/00* (2013.01); *D21H 19/10* (2013.01); *D21H 25/04* (2013.01); *D21H 27/001* (2013.01)

(56) References Cited

U.S. PATENT DOCUMENTS

| | | | | | |
|---|---|---|---|---|---|
| 5,393,383 | A * | 2/1995 | Karvinen | D21F 3/04 | 162/274 |
| 5,534,116 | A * | 7/1996 | Karvinen | D21F 3/04 | 162/274 |
| 5,611,892 | A * | 3/1997 | Karvinen | D21F 3/04 | 162/193 |
| 5,662,778 | A * | 9/1997 | Laapotti | D21F 3/04 | 162/306 |
| 5,833,810 | A * | 11/1998 | Laapotti | D21F 3/04 | 162/360.3 |
| 5,876,565 | A * | 3/1999 | Laapotti | D21F 3/04 | 162/358.5 |
| 6,533,900 | B2 * | 3/2003 | Puustinen | C04B 26/10 | 162/193 |
| 6,849,159 | B1 * | 2/2005 | Ilvespaa | D21G 9/0063 | 162/193 |
| 7,628,891 | B2 * | 12/2009 | Gronych | D21F 3/045 | 162/359.1 |
| 9,523,173 | B1 * | 12/2016 | Tonello | D21F 3/0209 | |
| 9,587,355 | B2 * | 3/2017 | Bertrand | D21H 23/56 | |
| 2001/0015268 | A1 * | 8/2001 | Mayer | D21F 2/00 | 162/202 |
| 2003/0170414 | A1 * | 9/2003 | Sato | D21H 19/82 | 428/40.1 |
| 2004/0149415 | A1 * | 8/2004 | Bricco | D21F 1/20 | 162/355 |
| 2005/0011624 | A1 * | 1/2005 | Korhonen | D21F 3/045 | 162/205 |
| 2006/0011319 | A1 * | 1/2006 | Honkalampi | D21F 3/045 | 162/205 |
| 2006/0191654 | A1 * | 8/2006 | Theisen | D21H 19/32 | 162/135 |
| 2007/0028481 | A1 * | 2/2007 | Gronych | D21F 3/045 | 34/397 |
| 2014/0338849 | A1 * | 11/2014 | Kosonen | C08B 15/04 | 162/1 |
| 2017/0284024 | A1 * | 10/2017 | Kotilainen | D21F 3/04 | |

FOREIGN PATENT DOCUMENTS

| | | | | |
|---|---|---|---|---|
| EP | 1316641 | A1 * | 6/2003 | D21F 3/04 |
| EP | 2722426 | A1 | 4/2014 | |
| EP | 2722434 | A1 * | 4/2014 | D21F 2/00 |
| EP | 2722435 | A1 * | 4/2014 | D21F 2/00 |
| EP | 2722435 | A1 | 4/2014 | |
| EP | 2722436 | A1 * | 4/2014 | D21F 2/00 |
| EP | 2369053 | B1 * | 4/2015 | D21F 2/00 |
| EP | 2072673 | B1 * | 7/2015 | D21F 2/00 |
| WO | 2014091071 | A1 | 6/2014 | |
| WO | WO-2016042198 | A1 * | 3/2016 | D21H 27/001 |
| WO | WO-2017207475 | A1 * | 12/2017 | D21F 1/32 |

OTHER PUBLICATIONS

Biermann, Christopher J. in "Essentials of Pulping and Papermaking," Academic Press, Inc., (Year: 1993).*

International Search Report for International Application No. PCT/FI2014/050702; Date of Completion: Nov. 27, 2014; dated Dec. 5, 2014; 2 Pages.

Written Opinion of the International Search Authority for International Application No. PCT/FI2014/050702; International Filing Date: Sep. 15, 2014; dated Dec. 5, 2014; 6 Pages.

* cited by examiner

PROCESS TO MANUFACTURE LOW WEIGHT HIGH QUALITY PAPER FOR USE AS A SUPPORT LAYER OF A RELEASE LINER WITH A BELT ASSEMBLY

CROSS-REFERENCE TO RELATED APPLICATIONS

This application is a National Stage application of PCT/FI2014/050702, filed Sep. 15, 2014, of which is incorporated by reference herein in its entirety.

FIELD OF THE INVENTION

The invention relates to a method for obtaining low weight high quality paper for use as a support layer of a release liner and products and uses thereof.

BACKGROUND

Adhesive labels are used to display and carry information on various industrial products. Prior to use, one or more adhesive labels may be attached on a special paper product referred to as a release liner. A release liner comprises a release coating, typically based on silicone, which forms a dehesive surface on the release liner. Paper for release liner is typically manufactured from chemically treated wood pulp, which is highly refined to obtain paper having a smooth surface and a high density for the release coating. Glassine paper may be used for release liner due to high surface density and good tensile strength.

SUMMARY

A particular use for a release liner is as backing material in labelling applications with adhesive labels. Adhesive labels may be, for example, self adhesive labels or pressure sensitive labels (PSA). A release liner comprising a plurality of adhesive labels is typically wound on a roll and used in a labelling process. The volume of products to be labelled in a labelling process may be large. Each time a roll containing labels is changed for a new roll in a labelling process, the cost efficiency of the labelling process decreases. Therefore, increasing the amount of labels on a single roll of release liner is desired. Automated labelling systems in particular benefit of increased amounts of labels on a single roll of release liner.

A roll of release liner may comprise several kilometers of winded release liner. To add more labels on a single roll of release liner in a cost efficient manner, the release liner should be thinner. However, while thus capable to comprise more labels on a single roll, the release liner should also withstand the functional requirements set by the labelling system. In particular, the mechanical properties of the release liner, such as stiffness, tearing resistance and surface properties, should be suitable for the release liner to function properly on an automated labelling system operating at a high speed.

When manufacturing a release liner, chemically treated wood pulp is refined to a high level to obtain paper having a smooth surface with high density, prior to applying a primer layer. To further improve the smoothness and density of a paper surface for a release coating, the paper is calendered before or after applying a primer layer on the paper surface. A smooth and tight paper surface enables use of less release coating. To obtain high quality release liner, refining of the wood pulp to a Schopper Riegler (SR)

Freeness test value above 50 has typically been necessary, which is a high degree of refining. Schopper Riegler (SR) Freeness is a test used to measure the extent of refining of a chemical pulp. The test provides an empirical measurement value of the drainage resistance of a pulp slurry. A higher Schopper Riegler (SR) Freeness test value indicates higher amount of water to be removed from a formed paper web during the release liner manufacturing process. Water molecules attach to cellulose fibres through hydrogen bonding. During paper web de-watering and heating, moisture is removed and the remaining cellulose fibres begin to form hydrogen bonds with each other instead. A high Schopper Riegler (SR) Freeness value, therefore, also indicates decreased dimensional stability of a paper web formed from the pulp. In other words, higher refining of the wood pulp, which may be observed by an increased Schopper Riegler (SR) Freeness test value, increases the shrinkage of the formed paper web. The shrinkage may occur both in the machine direction of the paper web movement and in the cross direction perpendicular to the machine direction.

When manufacturing a release liner, the shrinkage is particularly problematic when the dry content of the paper web is still low, especially between a press section and a dryer section on a paper machine. The shrinkage to the machine direction may be controlled to some extent by providing tension on the web. The tension on the web, however, increases the risk of a web break. The risk of a web break is particularly high between a press section and a drying section on a paper machine, where a gap may exist, when the paper web is not supported by any solid surface. Further still, paper web tension in the machine direction increases surface porosity and reduces the tearing resistance of the formed paper. Equally problematic is the shrinkage in the cross direction, as this makes it difficult to operate the release liner manufacturing process in an efficient manner. Due to the shrinkage in cross direction, the width of a paper roll manufactured from the paper web may not be sufficient for a desired number of slitted paper rolls. There exists a desire to increase the production capacity of a paper machine. The production capacity may be increased by providing means to increase the paper web velocity on the paper machine. When increasing the paper web velocity, however, the paper web in general needs to be drawn to a greater extent in machine direction, to maintain the runnability of the paper machine. A higher web tension, however, decreases the smoothness and density of the formed paper, which is problematic in paper for release liner. The density of the formed paper is related to the amount of release coating required to obtain a functional release liner.

An object of this invention is to solve above-mentioned problems by providing a method for manufacturing paper for use as a support layer of a low weight, high quality release liner.

According to an aspect of the invention, a method for manufacturing paper suitable for use as a support layer of a release liner may comprise:

- forming a paper web from pulp slurry,
- reducing moisture content of the paper web by a press section,
- supporting the paper web by a belt across a distance from a first contact point in the press section to a first separation point on a drying section,
- drying the paper web to form paper, and
- heating the paper web when supported by said belt such that the temperature of the paper web is in the range of 56 to 99° C. at the first separation point, and the dry content of the paper web is equal to or higher than 40 wt.-% at the first separation point.

According to a second aspect of the invention, a method for manufacturing paper suitable for use as a support layer of a release liner may comprise:

forming a paper web from pulp slurry, reducing moisture content of the paper web by a press section, supporting the paper web by a belt across a distance from a first contact point in the press section to a first separation point in a drying section, drying the paper web to form paper, and heating the paper web such that the temperature profile of the paper web in machine direction is non-decreasing between a second contact point in the press section where the paper web first contacts with the belt and the separation point in the drying section.

In an embodiment, the method may comprise heating of the paper web when supported by said belt such that the temperature of the paper web is in the range of 56 to 99° C. at the first separation point. The dry content of the paper web may be equal to or higher than 40 wt.-% at the first separation point.

The paper web may be supported across the press section to the drying section on a paper machine. The supporting of the paper web by a belt across the press section to the drying section provides means to reduce paper web tension across the press section to the drying section on a paper machine in the machine direction. A thermally conductive belt may be used to provide a non-decreasing temperature profile of the paper web between a first nip of the press section and a first separation point SP1 in the drying section. By heating of the paper web to a temperature of at least 56° C. already in the press section, the water content of the paper web may be reduced by pressing. The pressing may be done by means of one or more nips formed by rolls adjacent to each other. By arranging a paper web temperature in the range of 56° C. to 99° C., when supported by the belt, the water content of the paper web may be reduced. A thermally conductive belt provides means to heat the paper web and reduce tension in the machine direction such that a paper web dry content equal to or higher than 40 wt.-% may be reached before the paper web enters the drying section. A higher dry content of the paper web reached, while supported, before the paper web enters the drying section, may be used to reduce the shrinkage of the paper web in the machine direction and in the cross direction. The combined effect of a supported paper web having an increased reduction of the moisture content of the paper web already at an earlier stage of the paper manufacturing process, before entering the drying section, further enables a reduction in the refining of the pulp. The reduced refining further improves the mechanical properties of the paper, such as tearing resistance and dimensional stability in machine direction and cross direction. The reduced refining and good mechanical properties of the paper enable production of low weight paper for release liner, having high quality and grammage equal to or less than 78 g/m$^2$, preferably equal to or less than 60 g/m$^2$. The process is also cost efficient, as less energy may be used for refining the pulp. Less energy may also be used in the drying section of the paper machine. The paper surface may further be calendered in reduced moisture content, for example to a thickness equal to or less than 80 micrometers, preferably equal to or less than 60 micrometers. Due to low grammage and high surface density, also the amounts of raw material used in the release liner manufacturing process, such as the amount of primer layer and the amount of release coating, may be reduced.

Objects and embodiments of the invention are further described in the independent and dependent claims.

Figure 1:
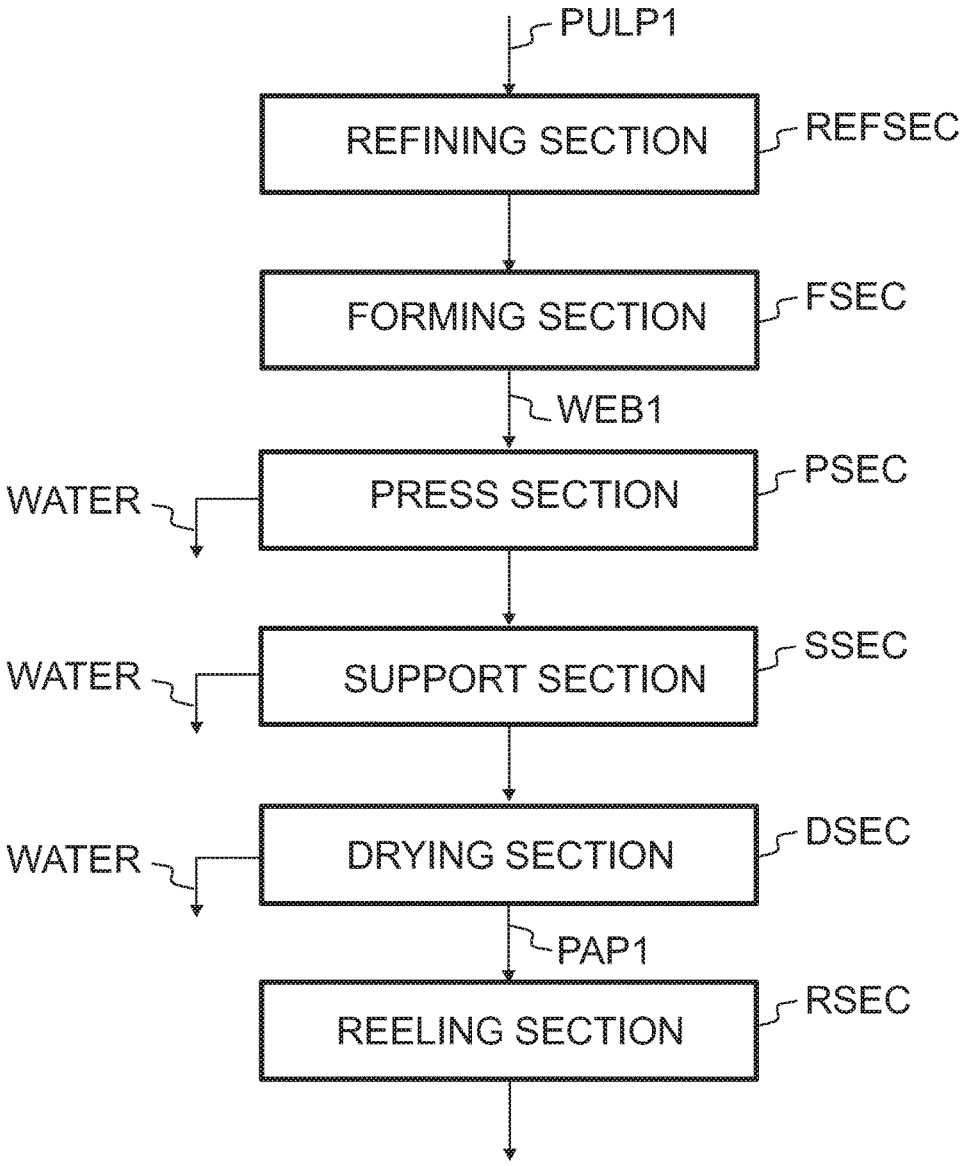
FIG. 1 illustrates, by way of an example, a release liner manufacturing process.

In the figures, $S_x$, $S_y$ and $S_z$ represent coordinate directions orthogonal to each other.

DETAILED DESCRIPTION

A release liner is this application refers to a paper based product having a substrate layer and a release coating. A release liner may be used as backing or support material for a product having an adhesive surface. A release liner is in particular usable as a combination comprising the release liner and an adhesive label or labelstock for automated labelling. The substrate layer comprises a paper support layer coated with a primer layer, the substrate layer being suitable to be coated with a release coating. A support layer surface having a high density is desired, as a tight paper surface enables reduced amounts of primer layer to be used. A tight paper surface may enable a primer layer having a novel composition. A high quality release liner support layer is manufactured from chemically treated wood pulp. A typical example of a release coating contains silicone polymer, and the coating is applied in a quantity of equal to or less than 2 g/m$^2$ per side, such as in the range of 0.7 to 2 g/m$^2$, preferably in the range of 0.8 to 1.5 g/m$^2$. An average amount of release coating applied is about 1 g/m$^2$ per side. The grammage of the paper plays a role in the amount of silicone coating required to obtain a sufficiently tight release liner surface. In general, it is demanding to manufacture low weight paper for release liner having a uniformly tight surface. When using papers having a grammage over 50 g/m$^2$, some surface defects may be tolerated. However, when low weight paper is used, such as paper having a grammage equal to or less than 50 g/m$^2$, even small surface defects, such as weak spots, may have a visible impact on the applied release coating. The risk of defects, for example stains, ruptures or weak spots, is higher when manufacturing low weight paper for release liner having reduced mechanical strength, in particular when the paper web dry content is still low. The risk of defects is increased, when the velocity of the paper web is increased. A paper for release liner typically has a velocity of at least 600 meters per minute, for example in the range of 600 to 1500 meters per minute in machine direction. Furthermore, defects, such as increased amount of surface porosity or weak spots, require higher amount of release coating applied on a substrate layer surface to obtain a sufficiently dense release liner surface. A release liner surface which is not sufficiently dense may cause problems in the end applications. For example, an adhesive applied on the release liner surface may migrate through the release liner. The amount of silicone used to provide a release coating on a release liner is a significant cost factor. Therefore, a minimum amount of release coating, which provides suitable release properties, is desired. Suitable release properties refer to homogeneous dehesive properties throughout the primer layer surface provided by the release coating, such that release force required to detach an adhesive label from the surface is constant and low. The primer layer and the release coating may be applied on one or both sides of the support layer.

Paper Types

The release liner support layer is paper manufactured on a paper machine. In release liner manufacturing, paper quality and suitability for coating with a silicon polymer based compound (i.e. release coating) may be determined based on the smoothness, density, porosity and transparency of the paper. Bekk method may be used for determining the smoothness and/or porosity of paper for release liner. For the Bekk method, ISO 5627 standard may be used. Gurley method may be used for determining the air permeance of paper. For the Gurley method, ISO 5636-5:2013 standard may be used.

Other characteristics typical for a paper suitable for release liner are smoothness of at least 900 sec/min (ISO 5627), density in the range of 1.0 to 1.2 (grammage (ISO536) per thickness (ISO534)), porosity equal to or less than 15000 pm/Pas (ISO11004) and transparency of at least 45% (ISO2470), the parameter values corresponding to ISO standards referred in parentheses. In practice, paper types lending themselves for release liner applications are vegetable parchment, greaseproof paper, coated papers and glassine. Of these, glassine is preferred for industrial manufacturing of high quality release liner, due to the mechanical properties of the paper obtained in the manufacturing process.

Vegetable parchment paper is a paper typically made of waterleaf sheet (unsized sheet of paper, made from chemical wood pulp) by treating it in a bath of sulfuric acid. The treated paper is washed thoroughly to remove the acid and then dried. This chemical treatment forms a very tough, stiff paper with an appearance similar to a genuine parchment. However, paper treated in this manner has a tendency to become brittle and to wrinkle upon drying. Vegetable parchment is therefore often treated with a plasticizing agent, such as glycerine or glucose.

Coated papers comprise variety of papers, having in common a coating layer applied on the paper surface and then calendered to modify the surface properties of the product. Coated paper which may be used as release liner is typically woodfree coated paper, made of chemical pulp, such as Kraft pulp. A coat weight in the range of 5 to 12 g/m$^2$ per side is generally used. By applying a mixture containing pigments (such as calcium carbonate (PCC) and/or kaolin) and binders (such as starch, polyvinyl alcohol and/or latex), different qualities such as weight, surface gloss, smoothness or reduced ink absorbency may be obtained. By changing the amount and composition of the applied coating mixture, paper suitable for different applications may be obtained.

Glassine is widely used in release liner for self-adhesive materials. Glassine is coated paper made of chemically treated wood pulp, having a grammage in the range of 30 to 160 g/m$^2$. In glassine, a coat weight in the range of 1 to 10 g/m$^2$ per side is typically used. Glassine used for manufacturing a release liner is coated with a primer layer which is compatible with a silicone polymer based release coating. A mixture used to form a primer layer for glassine may comprise water soluble binders such as starch, polyvinyl alcohol and/or carboxymethyl cellulose. When producing glassine paper, the pulp is refined to obtain a fiber fineness, which enables a dense, nearly unporous, paper surface to be obtained. Such a surface is resistant to air and liquids such as oil and water. When manufacturing glassine paper, the pulp slurry is first refined to a high level, the formed paper web is then pressed and dried, and a primer layer coating is applied on the paper web surface. Glassine is calendered with a multi-nip calender or a supercalender before or after applying the primer layer, to obtain a product having high density surface, high impact strength, high tear resistance and transparency. Glassine, however, has a lower dimensional stability than a conventional coated paper. Therefore, shrinkage of the formed fiber web when manufacturing glassine paper is higher than with conventional coated paper.

Greaseproof paper is similar to glassine in grammage. The main difference between greaseproof paper and glassine is in the calendering treatment. While glassine is typically supercalendered, greaseproof paper is not. Hence, greaseproof paper has a diminished tearing resistance when compared to glassine.

Manufacturing Paper for Use as a Support Layer of a Release Liner

FIG. 1 illustrates, by way of an example, a paper manufacturing process for a release liner. The manufacturing process may be described in the travel direction of a paper web WEB1 by sections referred to as a refining section REFSEC, a forming section FSEC, a press section PSEC, a support section SSEC, a drying section DSEC and a reeling section RSEC. The paper web WEB1 is formed from a pulp PULP1 at the forming section FSEC, and then transferred through the press section PSEC and the support section SSEC to the drying section DSEC to obtain an effective removal of water WATER and a dry content such that a primer layer may be applied on the formed paper PAP1 surface. Before or after applying the primer layer, the formed paper PAP1 may be surface treated by a calender, multi-nip calender or super calender to modify the surface properties of the paper PAP1 surface and to reach a the final thickness for the paper PAP1. After calendering treatment the paper PAP1 may be reeled up to a paper roll on the reeling section RSEC.

Web tension, i.e. draw of the paper web in a machine direction, is needed when the paper web passes unsupported over a gap on a paper machine. Web tension is used to keep the paper web tight in order to operate the paper machine. Web tension may obtained by arranging two rolls having a difference in velocities. Web tension is typically given as a velocity difference in percentages of the two rolls, for example between rolls on different sides of the gap. The velocity difference refers to a circumferential velocity difference between the first roll and the second roll. In practice, the amount of web tension required to operate the paper machine is proportional to the velocity of the paper web, i.e. production speed. A higher paper web velocity requires a higher web tension. The dry content of a paper web has an effect on the web tension. When the paper web is drawn in a machine direction, the dry content of the paper web should be sufficiently high to support the weight of the paper web. When the paper web is drawn in a machine direction at low dry content, the quality of the paper formed from the web may suffer, unless being supported. At the press section PSEC, the dry content of the web is still low, typically less than 40 wt.-%, such as in the range of 15 to 35%. Due to the low dry content, paper web breaks may occur. The risk of a web break is particularly high between the press section PSEC and the drying section DSEC, where a gap may exist, wherein the paper web is not supported by a solid surface. The gap may have a length of a few millimeters. The length of gap may be equal to or more than 10 millimeters. The length of gap may be up to several meters, such as in the range of a few millimeters up to several thousands of millimeters, for example in the range of 10 to 6000 millimeters, wherein the paper web is not supported by any solid surface in the paper web travel direction. When the paper web is drawn in a machine direction at low dry content, also the other dimensions of the paper web may be changed. When a paper web has a low dry content, the paper web material does not yet have sufficient strength to support its own weight without web tension. Web tension, which is the draw of the paper web in a machine direction, at low dry content of the paper web, may break the bonding between fibres in the paper web. Drawing of the paper web at low dry content of the paper web therefore reduces the strength of the paper formed from such paper web. Drawing of the paper web in a machine direction at low dry content may further cause shrinkage by reducing the width of the paper web in cross direction. The cross direction is perpendicular to machine direction. When the paper web having a low dry content is drawn in a machine direction, the formed paper comprises defects, which decrease the release coating compatibility of the paper.

To support a moving paper web from the press section to the drying section, a belt assembly may be used. A belt assembly provides a support, which may be used to reduce a tension generally used to keep the paper web tight between the press section and the drying section.

WO 2009/129843 discloses an example of a belt assembly, wherein both an endless, heat-conductive metal belt and an endless fluid-permeable felt belt have been arranged to sandwich a web in a pressing nip. The document describes that the web can be dried readily, while being attached to the metal belt, with a small draw of the web.

EP 2722435 A1 discloses an example of a belt assembly comprising a press nip comprising a first and a second press roll and a heat conductive metal belt passing through the press nip, where the second roll can be a suction roll to apply increased tension onto the web to improve water removal. By rising the temperature of the metal belt above 110° C. at the press nip, a combined steam enhanced water removal and pressing process can be enabled.

While a heated metal belt, as the cited literature above describe, may provide to some extent support and drying of a paper web between a press section and a dryer section, it is as such not applicable for the manufacturing of low weight, high quality paper for use as a support layer of a release liner. The temperature profile of the paper web, while on the belt has not been discussed. In particular, no teaching is given for the dry content values a paper should have, nor for reducing the shrinkage of such paper in cross direction.

Paper for use as a support layer of a release liner is formed of pulp on a paper machine. Paper for use as a support layer of a release liner may be formed of chemically treated pulp on a paper machine. Chemically treated pulp may be bleached. Bleaching removes compounds, such as lignin, from the pulp. The pulp is refined at a refining section prior to forming a pulp slurry. At the refining section, pulp which comprises water is subjected to shear and stress forces. As a result of the refining, cutting and fibrillation of the cellulose fibers is obtained. Refining may be performed by means of mechanical action, for example by using bars, drums, beaters or refiners. Refining, and in particular refining to a high degree, may sometimes be referred to as beating. Refining reduces the average fiber length of cellulose, which decreases the tear strength of a paper formed from the pulp. Refining also leads to fibrillation, wherein the cellulose fibre bundles conventionally tightly bound by hydrogen bonds become separated to some extent. The detachment of hydrogen bonds between fibers increases the pulp surface area and enables hydrogen bonding between fibers and water. The increased pulp surface area leads to hydration and the pulp absorbs water and swells. Refining increases the tensile and reduces the tearing strength of a paper formed from the pulp due to higher surface areas and increased hydrogen bonding between fibers. The amount of mechanical energy used in refining correlates with the reduction of fiber length and fibrillation. By using more energy, fibers having shorter average fiber length and increased surface area may be obtained. This enables formation of a dense and smooth paper surface. The amount of mechanical energy used in refining correlates with the water drainage resistance, which may be measured by the Schopper Riegler (SR) Freeness test. The Schopper Riegler (SR) Freeness value represents the inverse of the volume of water collected divided by ten. The Schopper Riegler (SR) Freeness value may be determined using a SCAN-C 19:65 test method. Pulp suitable for release liner support layer manufacturing has typically been refined to a Schopper Riegler (SR) Freeness value up to 60 or more, such as above 50 or more, to obtain a sufficiently smooth and dense paper surface suitable for use as a support layer for high quality release liner support layer. While refining improves the formation of smooth and dense paper surface, it increases the need for water removal from the paper web during manufacturing. Furthermore, refining decreases the dimensional stability of the formed paper web. In other words, when dried during manufacturing, the formed paper web has a tendency to shrink both in the machine direction and cross direction.

The refined pulp is mixed with water to form pulp slurry. The basic qualities of the paper, such as paper type and suitability for different applications, are already determined to a large extent when forming the paper web from the pulp slurry. Chemicals, such as viscosity modifiers, pigments or binder material, may be added to the pulp slurry. At a forming section, the formed pulp slurry is fed into a paper machine to form a paper web. Pulp slurry for release liner paper manufacturing is typically introduced in a concentration between 0.25 and 3 wt.-%, such as in the range of 0.3 and 2 wt.-%, preferably less than 1 wt.-%, such as in the range of 0.3 to 0.8 wt.-%. The weight percentage (wt.-%) refers to the dry content of the mixture. The dry content of the mixture is defined as the concentration of solids by weight in a mixture. The dry content of a paper web is defined as the concentration of solids by weight in a paper web. The dry content of a paper web formed from a pulp slurry, comprises both fibers derived from the pulp slurry and any chemicals such as pigments or binder material added on the forming section, which remain in the paper web. In other words, a formed paper web comprises both water (moisture) and solid matter, wherein the weight percentage (wt.-%) of the solid matter of the paper web is denoted as the dry content of the paper web. The dry content of a paper web may be determined by laboratory methods such as by oven drying. For example, the dry content of a paper web may be determined according to standard SCAN-C 3:78 (Determination of dry matter content—Oven-drying method). To enhance the reliability of a single dry content determination procedure, the dry content is determined as an average dry content of five or more samples taken from the same position in the manufacturing process. Each sample represents the same measurement position in the manufacturing process. In practice, the samples may be obtained by allowing the paper web to pass said measurement position, and by allowing the paper web to fold loose immediately after the measurement position for gathering of the samples. A measurement position may be located, for example, after a first separation point in a drying section of the paper machine, where the paper web is detached from a thermally conductive belt. A minimum sample weight of 300 g or more per sample is used. The sample weight may be adapted based on the used laboratory equipment, such that the volume of the sample is less than 10% of the volume of the oven used for determining the dry content. A 24 hours period for oven drying is used. The dry content of a paper web may also be determined by calculation from the manufacturing process, when the paper web velocity, the paper web temperature and the moisture reduction rate on the paper machine is monitored. The paper machine may comprise one or more velocity sensors. The paper machine may comprise one or more temperature sensors. The paper machine may comprise one or more sensor for monitoring the moisture reduction rate. A control unit may be connected to the sensors. The sensors may provide information of the velocity and temperature of the paper web at different points. The information may be received by the control unit. The control unit may comprise a signal processing unit. The signal processing unit may process information provided by the control unit to calculate the dry content of a paper web at a given point in the manufacturing process.

While a high refining level of pulp has generally been held to be a prerequisite for obtaining high quality paper for release liner, it was unexpectedly observed, that it was possible to reduce the refining of the pulp when supporting and heating the paper web sufficiently already at an earlier stage of the paper manufacturing process, before entering the drying section. It was furthermore observed, that a high temperature of the paper web both at the press section during dewatering by pressing, and when being supported by a belt, improved the dewatering process significantly. In the press section, the heating was performed advantageously on at least two or more press nips. Preferably, three or more press nips were used. A reduction of moisture of the paper web in the press section by means of heating, before contact with the belt, was observed to improve the reduction of moisture of the paper web further. This had the effect, that a higher dry content level of the paper web was achieved already at the press section. In the support section, the heating and reduction of moisture by evaporation could then be performed more efficiently at a higher paper web dry content, before entering the drying section. It was furthermore observed, that the dimensional stability of the paper web both in machine direction and cross direction of the paper web was improved, and could be further improved by reduction in the refining level of the pulp. The increased dimensional stability, combined with the support of the paper web by the belt, enabled reducing the rotational speed difference of rolls used to produce web tension. A higher paper web velocity on the paper machine with better manufacturing process control could be achieved. A reduced refining level combined with improved removal of moisture at an early stage of the paper manufacturing process enables a manufacturing of a paper web having better dimensional stability, less curling tendency and sufficient mechanical properties, such that the formed paper was suitable for use as a release liner support layer. The improved speed and enhanced water reduction also provided increase in release liner production amounts on the paper machine.

By providing a belt assembly on a paper machine between a press section and a drying section, the paper web could be supported. A belt assembly comprises two or more rolls inside a belt loop, wherein the rolls stretch the belt loop in place and guide the belt. The belt assembly is adapted to move a paper web from a press section of a paper machine to a drying section of the paper machine in a machine direction. To support the paper web, the belt is kept in tension. The belt therefore needs to have tension strength. The belt can be made of metal or synthetic material. Preferably, a thermally conductive belt is used for supporting the paper web. When a thermally conductive belt is used, the paper web is in thermal contact with the belt, while being supported. Thermal contact provides means for heat conduction, which is an effective way for heating and contact drying the paper web. A thermally conductive belt may have a temperature control. The temperature of the thermally conductive belt may be controlled by separate means of heating. Heating means may be, for example a steam box, an electrical dryer or an impingement dryer, which may be used to increase the temperature of the thermally conductive belt. The heating means are in thermal contact with the belt loop to enable heat transfer from the heating means to the belt assembly. The heating means may be positioned on the inside and/or the outside of the belt loop. The advantage of a thermally conductive belt is, that in addition to supporting the paper web, the belt assembly may be used to transfer heat from the heating means to the press section of the paper machine. A thermally conductive belt may be used for heating the paper web such that the paper web has at least temporally a non-decreasing temperature profile in machine direction. A thermally conductive belt may be used for heating the paper web to obtain a desired temperature of the paper web in the press section and/or when contacting the belt and/or when being supported by the belt. The increase of the web temperature improves the reduction of moisture content of the paper web. Preferably, belt material having a thermal conductivity equal to or higher than 15 $Wm^{-1}$ $K^{-1}$ at 25° C. is used. The belt may, for example, consist essentially of material such as metal. The material of the belt may be stainless steel, the material of the belt having a thermal conductivity of 16 $Wm^{-1}$ $K^{-1}$ at 25° C. When using a metal belt, the surface of the belt may be coated. The coating may further be used to reduce or increase the surface roughness of the metal belt, which may be used to obtain a desired level of friction for holding the paper web on the surface of the belt. In addition to a thermally conductive metal belt, heat may be transferred to the press section by separate means of heating. For example, a further means of heating, such as a separate steam box, an electrical dryer or an impingement dryer may be used to provide heat to the paper web in the press section. The temperature of the paper web may be monitored at one or more locations on the paper machine. The temperature of the paper web may be monitored by a temperature sensor. The temperature sensor may provide first temperature information about the temperature of the paper web. The temperature of the thermally conductive belt may be monitored by a temperature sensor. The temperature sensor may provide second temperature information about the temperature of the metal belt. The temperature sensor may be a non-contact sensor. A preferable non-contact sensor is an infrared temperature sensor. A control unit may be connected to the temperature sensor. The control unit may be arranged to control one or more heating units based on the first and/or the second temperature information. A non-contact temperature sensor may be used in a wireless manner, such that the temperature of the paper web is monitored by a mobile a temperature sensor, which provides information about the temperature of the paper web and/or the temperature of the metal belt.

Figure 2:
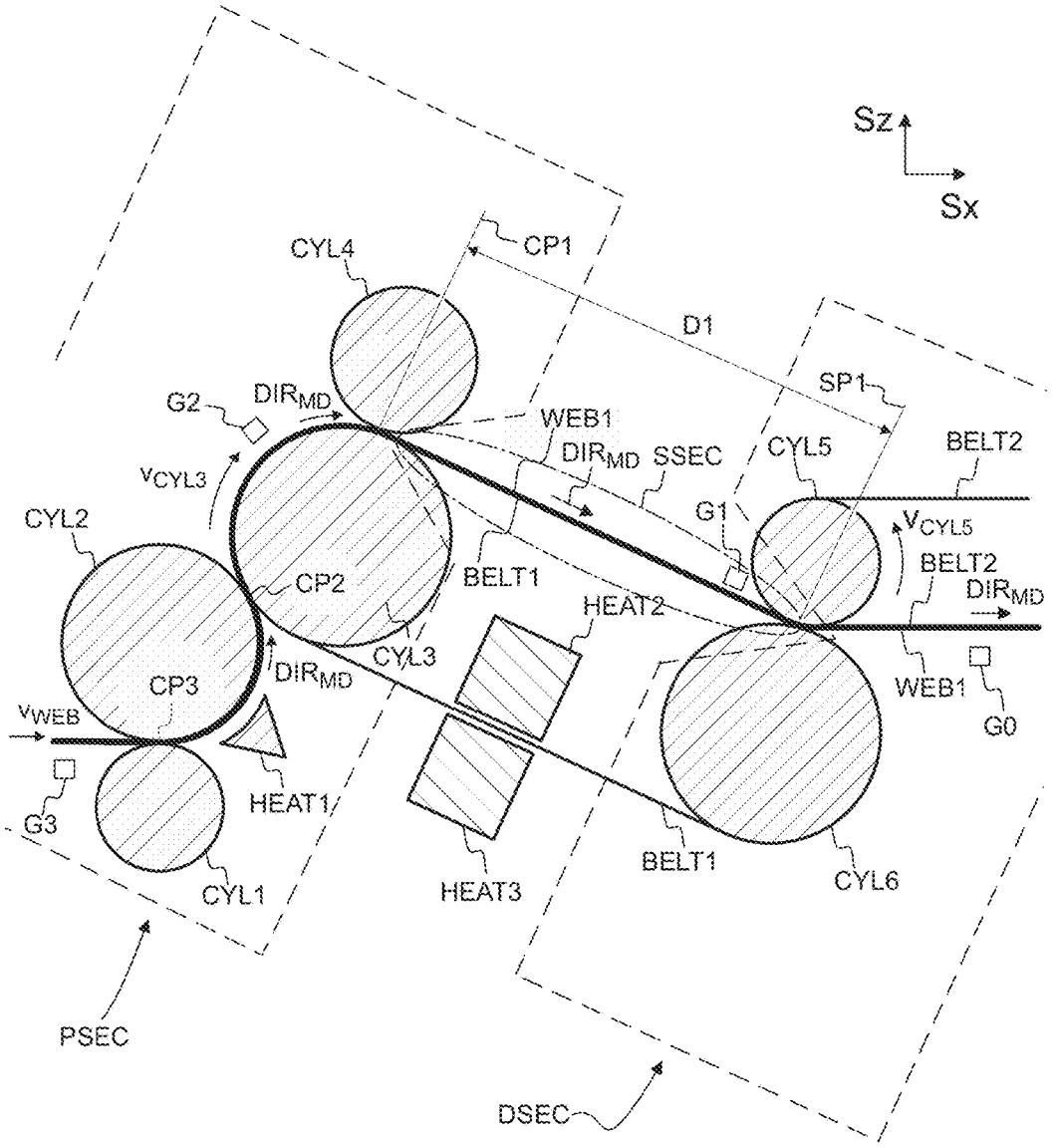
FIG. 2 illustrates, by way of an example, a schematic view of a press section and a drying section of a paper machine comprising a belt assembly.

FIG. 2 illustrates, by way of an example, a schematic view of a press section, support section and a drying section of a paper machine for release liner, comprising a belt assembly.

The press section PSEC of a paper machine typically comprises a number of rolls CYL1, CYL2, CYL3, CYL4 for guiding and/or pressing the paper web WEB1. Pressing is used to reduce the moisture content of the paper web WEB1. The press section PSEC may further be adapted to comprise a number of heating elements HEAT1 to increase the paper web WEB1 temperature. One or more of the of heating elements HEAT2, HEAT3 may be arranged adjacent to a belt BELT1 between the press section PSEC and the drying section DSEC. The belt may be moved by a draw roll CYL3 having a circumferential velocity $v_{CYL3}$ and guided by a roll CYL6. The distance between the rolls CYL3, CYL6 may be adjusted to provide tension to the metal belt. When a thermally conductive belt BELT1 is used, the belt BELT1 may be in thermal contact with a heating element HEAT2, HEAT3. The heating element HEAT2, HEAT3 transfers heat to the thermally conductive belt BELT1. A thermally conductive belt BELT1 may therefore be used to for heating the paper web WEB1 already at the press section PSEC. After the press section PSEC, the paper web may have a dry content level equal to or more than 15 wt.-%. After the press section PSEC, the paper web may have a dry content level, for example in the range of 15 to 35 wt.-%.

The support section SSEC of a paper machine is between the press section PSEC and the drying section DSEC. A distance D1 is used to define the length of a gap at the support section SSEC, the gap separating the press section PSEC and the drying section DSEC from each other. The distance D1 is given in the machine direction $DIR_{MD}$ of the paper web WEB1. When a belt BELT1 is provided between the press section PSEC and the drying section DSEC, the paper web WEB1 is supported by the belt BELT1 across the distance D1 from a first contact point CP1 in the press section PSEC to a first separation point SP1 in the drying section DSEC. When a thermally conductive belt BELT1 is used, the belt BELT1 may be used to for heating the paper web WEB1 at the support section SSEC, when the paper web WEB1 is supported by the belt BELT1. After the support section SSEC, when heating the paper web WEB1 while being supported, the paper web WEB1 may have a dry content level equal to or more than 40 wt.-%. After the support section PSEC, the paper web WEB1 may have a dry content level, for example in the range of 40 to 55 wt.-%.

The drying section DSEC of a paper machine typically comprises a number of rolls CYL5, CYL6 for guiding and/or drying the paper web. A felt belt BELT2 may be arranged to guide the paper web forward in the drying section DSEC. Drying is used to further reduce the moisture content of the paper web WEB1. In the drying section DSEC, the paper web is further heated to evaporate most of the remaining moisture in the paper web WEB1 The drying section DSEC comprises means for drying the paper web WEB1. Means for drying the paper web WEB1 may comprise, for example, a number of rolls, such as steam heated cylinders, arranged in contact with the paper web. The temperature of the paper web WEB1 in the drying section DSEC is generally in the range of 60 to 140° C. After drying section, the paper web may have a dry content level equal to or more than 90 wt.-%. After drying section, the paper web may have a dry content for example in the range of 90 to 95 wt.-%.

The paper web WEB1 has a velocity $v_{WEB}$. Web tension may be arranged to support the paper web WEB1 moving at a velocity $v_{WEB}$. Web tension refers to the draw produced on a paper web WEB1 having a velocity $v_{WEB}$. Web tensions is given as a difference in the velocity of two rolls drawing the paper web, said rolls producing a draw on the paper web between said rolls. Referring to the FIG. 2, web tension may be given as a difference in the velocity of two rolls, the roll located on different sides of a gap, the rolls having a circumferential speed difference, according to the following equation:

$$\Delta v_{WEB}=(v_{CYL5}-v_{CYL3})/v_{CYL3}*100\%,$$

wherein $\Delta v_{WEB}$ is the web tension, and $v_{CYL5}$ is a velocity (rotational speed) of a drawing roll CYL5 in the drying section DSEC, and $v_{CYL3}$ is a velocity (rotational speed) of a drawing roll CYL3 in the press section PSEC, and the velocity of the drawing roll CYL5 in the drying section DSEC having a higher value than the drawing roll CYL3 in the press section PSEC.

Before producing a draw on the paper web, the velocity $v_{WEB}$ of the paper web WEB1 is equal to the velocity $v_{CYL3}$ of the third roll CYL3 in the press section PSEC. After producing a draw on the paper web, the velocity $v_{WEB}$ of the paper web WEB1 is equal to the velocity $v_{CYL5}$ of the fifth roll CYL5 in the drying section DSEC. To provide tension on the paper web WEB1, the third roll CYL3 and the fifth roll CYL5 may be arranged to rotate in opposite directions. When the paper web WEB1 is not supported across the distance D1 from a first contact point CP1 in the press section PSEC to the first separation point SP1 in the drying section DSEC, the velocity $v_{CYL5}$ of the fifth roll CYL5 may be at least 4% higher, such as in the range of 4% to 6% higher than the velocity $v_{CYL3}$ of the third roll CYL3, to provide sufficient tension to the paper web WEB1. When a belt BELT1 is provided between the press section PSEC and the drying section DSEC, the web tension may be reduced. When a belt BELT1 is provided, the difference between the second velocity ($v_{CYL5}$) and the first velocity ($v_{CYL3}$) may be less than 4%, preferably less than 3.5% of the first velocity ($v_{CYL3}$). When a belt BELT1 is provided, the velocity $v_{WEB}$ may be higher than without a belt BELT1.

The paper web WEB1 is conveyed from the forming section to the press section PSEC at the velocity $v_{WEB}$. The function of reducing moisture at the press section PSEC is also referred to as dewatering of the paper web. The press section PSEC comprises means for mechanically pressing the paper web WEB1. The press section PSEC may comprise, for example, a shoe press and/or a rotating roll for pressing the paper web WEB1. The press section typically comprises a number of rolls CYL1, CYL2, CYL3, CYL4, which are cylinders for pressing and guiding the paper web WEB1 through the press section. The rolls CYL1, CYL2, CYL3, CYL4 may be arranged such that two or more rolls form a series of two or more, such as three or four nips. When passing between a nip formed by a pair of rolls, the paper web WEB1 is subjected to a press force. Means for pressing may comprise, for example, press rolls forming a press nip. A press nip may have a nip pressure in the range of 50 to 150 kN/m. Means for pressing may comprise a shoe press, the shoe press having a nip pressure in the range of 700 to 1450 kN/m. A nip defines a contact point CP1, CP2, CP3, where the paper web WEB1 is guided through two adjacent rolls. At each contact point CP1, CP2, CP3 the paper web WEB1 is pressed to reduce the moisture content. Any of the contact points CP1, CP2, CP3 or the separation point SP1 may be referred to as contact line, which is substantially parallel to axis of roll CYL3. The contact line may be substantially perpendicular to the machine direction $DIR_{MD}$.

The velocity $v_{WEB}$ of the paper web is in machine direction $DIR_{MD}$ of the paper machine, which refers to travel direction of the paper web. Travel direction is the path the paper web travels from the forming section towards the reeling section on the paper machine. Travel direction of the paper web may be used to explain a relative position of various objects of the paper machine. For example, the press section PSEC is positioned before the drying section DSEC, in the travel direction of the paper web WEB1. In other words, the travel direction of the paper web is the direction in which the paper web WEB1 moves, when passing from the press section PSEC to the drying section DSEC.

Effects of the Web Temperature on Press Section to Dewatering Process

The viscosity of water depends on temperature. At 20° C., the absolute viscosity of water is 1.002 mNs/m$^2$, at 40° C., 0.653 mNs/m$^2$ and at 60° C., 0.467 mNs/m$^2$. At 70° C., the absolute viscosity of water is 0.404 mNs/m$^2$, at 80° C., 0.355 mNs/m$^2$ and at 90° C., 0.315 mNs/m$^2$. At 100° C., which is the boiling point of water in normal atmospheric pressure, the absolute viscosity of water is 0.282 mNs/m$^2$. Water having a higher temperature, and thus a lower viscosity, is more efficiently pressed out of the paper web. When providing heat to the press section PSEC, the paper web WEB1 temperature may be raised, and consequently the viscosity of water may be decreased. The temperature of the paper web WEB1 is typically less than 56° C. at a first nip of the press section PSEC, the first nip being defined by a third contact point CP3. The third contact point CP3 denotes the inlet point of the paper web WEB1 to the press section PSEC. Conventionally, the temperature of a paper web WEB1 has been 55° C. or less, such as in the range of 45 to 55° C., at the first nip of the press section PSEC. To enhance the reduction of moisture of the paper web WEB1 in the press section PSEC, the temperature of a paper web WEB1 may be increased by heating. The temperature of a paper web WEB1 while on the press section PSEC, may be increased, for example, by 1° C. or more. Advantageously, the paper web WEB1 is heated such that the temperature of the paper web WEB1 is in the range of 56 to 99° C. at the first contact point CP1 in the press section PSEC. More advantageously, the paper web WEB1 is heated such that the temperature of the paper web WEB1 is equal to or higher than 56° C. after the paper web WEB1 first contacts with the thermally conductive belt BELT1. The paper web WEB1 first contacts with the thermally conductive belt BELT1 at a second contact point CP2, which is positioned before the first contact point CP1 in the press section PSEC in the machine direction $DIR_{MD}$ of the paper web WEB1. The temperature of the paper web WEB1, after the paper web WEB1 first contacts with the thermally conductive belt BELT1, may be in the range of 56 to 99° C. By heating a paper web WEB1 to a temperature of at least 60° C., the viscosity of water is decreased over 50%, when compared to the viscosity of water at 20° C. or over 28%, when compared to the viscosity of water at 40° C. To increase the temperature of the paper web WEB1 on the press section, heating means may be provided. The heating means may comprise one or more heating elements HEAT1, HEAT2, HEAT3, each heating element arranged to provide heat to the paper web WEB1. A heating element HEAT1, HEAT2, HEAT3 may comprise, for example, a hot steam chamber, a hot water chamber, infrared light heating unit, hot air blowing unit or a combination of one or more of these. Instead, or in addition to a heating element HEAT1, HEAT2, HEAT3, one or more of the press rolls may comprise a heat transferring roll, such as a thermo roll. A first heating element HEAT1 may be provided near the third contact point CP3, serving as an entry point for the paper web WEB1 to the press section PSEC. The heating element HEAT1 may be located, for example, in the press section PSEC, between the third contact point CP3 and the second contact point CP2. The heating element HEAT1, may be, for example, a steam box directed towards the press roll CYL2 guiding the paper web WEB1 through the press section PSEC. A control unit may be arranged to control the temperature of one or more of the heating means, which may be referred to as heating units. The temperature of the heating units may be controlled, for example, based on temperature information received by one or more temperature sensors connected to the heating units. The primary purpose of the first heating element HEAT1 is in reducing the viscosity of water in the paper web WEB1 by heating the paper web WEB1.

Means to further remove moisture when pressing comprise, for example, increasing the amount of press nips CP1, CP2, CP3 in the press section. Furthermore, a press nip CP1, CP2, CP3 may be arranged to comprise a grooved roll as a press roll, or used in combination with a felt belt for absorbing the water pressed out from the paper web.

A Thermally Conductive Belt

Heating may be provided via a second heating element HEAT2 and/or a third heating element HEAT3. The heating elements HEAT2, HEAT3 may be an alternative or an additional means of heating for the first heating element HEAT1. The second heating element HEAT2 may a steam chamber, which heats a thermally conductive belt BELT1, arranged between the press section PSEC and a drying section DSEC of the paper machine. A thermally conductive belt BELT1 may be adapted to an endless loop around two or more rolls CYL3, CYL6, which, when in motion, provide means to move the belt BELT1 and transfer heat to the press section PSEC and to the paper web WEB1. When a third heating element HEAT3 is provided, the thermally conductive belt BELT1 may be heated either from one or from both sides. Advantageously, the third heating element HEAT3 may be similar to the second heating element, and located on opposite side of the thermally conductive belt BELT1, to provide an equal heating effect on both sides of the belt BELT1. The heating elements HEAT1, HEAT2, HEAT3 may be connected to a control unit. The control unit may receive temperature information from one or more temperature sensors to control the temperature of the paper web WEB1 in the press section PSEC and in the support section SSEC.

The thermally conductive belt BELT1 further provides means for supporting the paper web WEB1 over the distance D1 between the press section PSEC and the drying section DSEC. Supporting of the paper web WEB1 enables reducing the web tension on the paper web WEB1 in the machine direction between the press section PSEC and the drying section DSEC. Reducing the tension on the paper web WEB1 in the machine direction improves the density and strength of the paper web WEB1. The belt BELT1 contacts the paper web WEB1 at the second contact point CP2. Between the second contact point CP2 and the first contact point CP1, the paper web WEB1 is supported by the roll CYL3. From the first contact point CP1 in the press section PSEC to the first separation point SP1 in the drying section DSEC, the paper web WEB1 may be supported only by the belt BELT1. The first contact point CP1 is the nip between rolls CYL3, CYL4 at the press section PSEC. The first separation point SP1 is the point after the contact point CP1, where the paper web WEB1 is detached from the belt BELT1 at the drying section DSEC. A suction effect may be provided to detach the paper web WEB1 from the belt BELT1. The suction effect may be provided, for example, by using a suction roll CYL5. The suction roll may be a draw roll. Advantageously, the suction roll CYL5 may be a transfer suction roll. When a transfer suction roll is used, the paper web WEB1 is picked from the belt BELT1 to the suction roll CYL5 in a supported fashion, which reduces the need for web tension in machine direction across the distance D1. A guiding felt belt BELT2 may be arranged around the suction roll CYL5 to guide the paper web WEB1 further in the drying section DSEC. The first separation point SP1 may also be defined as a point in the machine direction $DIR_{MD}$ of the paper web WEB1 from the contact point CP1, wherein the paper web WEB1 contacts the felt belt BELT2 on the suction roll CYL5. The contact point CP1 may also be defined as the point where the belt BELT1 supporting the paper web WEB1 is detached from the third roll CYL3 at the press section PSEC.

At the press section PSEC, the paper web WEB1 contains large amounts of water. Typically over half of the weight of the paper web, such as in the range of 65 to 85 wt.-%, is due to the moisture content of the paper web WEB1. Heating of the water requires energy. When pressing the paper web at the press section PSEC, the moisture content of the paper web WEB1 is reduced. Consequently, when the moisture content of the paper web WEB1 is reduced, the dry content of the paper web WEB1 is increased. When the paper web WEB1 is being supported by the belt BELT1, a further reduction of moisture is achieved by heating the paper web WEB1. A preferred way of heating the paper web WEB1 is by means of the thermally conductive belt BELT1, which has a capacity to store and transfer heat to a paper web WEB1. A thermally conductive belt BELT1 enables more controlled temperature profile for the paper web in the press section PSEC and the support section SSEC before the drying section DSEC. A thermally conductive belt BELT1 having a capacity to store and transfer heat may be used to provide a non-decreasing temperature profile to the paper web WEB1. A thermally conductive belt BELT1 may be arranged in thermal contact with the paper web WEB1 to increase the heat flux experienced by the paper web WEB1 on the press section PSEC and the support section SSEC before the drying section DSEC. A non-decreasing temperature profile in this context refers to two or more paper web WEB1 temperatures measured between two or more positions of the paper web WEB1, wherein said temperatures between said positions are monotonically increasing in the machine direction $DIR_{MD}$ of the paper machine. The temperature profile of the paper web WEB1 may be determined by temperature sensors G0, G1, G2, G3. A non-decreasing temperature profile thus preserves the order, such that the measured temperature of two sensors G2, G1 in machine direction $DIR_{MD}$ is equal, or the temperature of a temperature sensor G1 later in machine direction $DIR_{MD}$ is higher. The reduction of moisture of the paper web WEB1, when supported by the belt BELT1 across the distance D1, is to a large extent through evaporation of moisture. To enhance the reduction of moisture of the paper web WEB1 when supported by the belt BELT1 across the distance D1, the paper web WEB1 may be heated such that the temperature of the paper web WEB1 is equal to or higher than 56° C., preferably equal to or higher than 60° C. at the first separation point SP1. Advantageously, the paper web WEB1 may be heated such that the temperature of the paper web WEB1 is equal to or higher than 56° C., preferably equal to or higher than 60° C. at the first contact point CP1. The paper web WEB1 may be heated, for example such that the temperature of the paper web WEB1 is in the range of 56 to 99° C., preferably equal to or higher than 60° C. at the first separation point SP1 and/or at the first contact point CP1. Heating of the paper web WEB1 when supported by said belt such that the temperature of the paper web WEB1 is equal to or higher than 56° C., such as in the range of 56 to 99° C., at the first separation point SP1, enables a dry content of the paper web WEB1 equal to or higher than 40 wt.-% at the first separation point SP1. When heating the paper web WEB1 such that the temperature profile of the paper web WEB1 is non-decreasing between the second contact point CP2 and the first contact point CP1 of the press section PSEC, such that the temperature of the paper web WEB1 is in the range of 56 to 99° C. at the first separation point SP1, a dry content equal to or higher than 40 wt.-% may be reached earlier. The temperature profile of the paper web WEB1 may be non-decreasing between the first nip defined by contact point CP3 in the press section PSEC and the first separation point SP1 in the drying section DSEC. This reduces moisture content of the paper web WEB1 and improves strength of the paper web WEB1, which enables higher paper velocity $v_{WEB}$. Preferably, the temperature of the paper web WEB1 may be less than 90° C. at the first separation point SP1. When heating the paper web WEB1 at the press section PSEC and the support section SSEC, the temperature difference of the paper web WEB1 between press section PSEC and the drying section DSEC may be reduced. The temperature control and efficiency of the drying section DSEC may thus be improved. While later in the drying section DSEC, after the first separation point SP1, the temperature of the paper web WEB1 may be higher than 100° C., further drying of the paper web WEB1 in the drying section DSEC may be easier to control when having a lower temperature at the first separation point SP1. A lower temperature at the first separation point SP1 refers to a temperature in the range of 56 to 99° C., preferably in the range or 65 to 85° C., most preferably in the range of 68 to 85° C. In a paper machine without a thermally conductive metal belt BELT1, the temperature of the rolls at the first separation point SP1 of the drying section DSEC is generally lower, such as in the range of 55 to 65° C. When heating the paper web with a thermally conductive metal belt BELT1 in the support section SSEC as described above, the dry content of the paper web WEB1 is increased. In a paper machine without a thermally conductive metal belt BELT1, when the paper web has a low dry content less than 40%, high temperature of the rolls in the drying section DSEC tends to attach the paper web on the rolls, which may be referred to as sticking. The increased dry content of the paper web WEB1 enables, that the paper web remains detachable from said rolls in the drying section DSEC.

The paper web WEB1 has a residence time $\Delta t_{D1}$, which relates to the time the paper web is supported by the belt BELT1 between the contact point CP1 and the separation point SP1. The residence time may be greater than or equal to $D1/v_{CYL5}$. The velocity $v_{CYL5}$ may be greater than or equal to velocity $v_{CYL3}$. For example, when the distance D1 is 1 meter, and the velocity of the paper machine is 1000 meters/minute, the residence time $\Delta t_{D1}$ is 1/1000 minutes (which equals to 0.6 seconds). Overheating refers to a paper web WEB1 residence time $\Delta t_{D1}$ on the belt BELT1, where the paper web WEB1 experiences too much heat flux. A critical heat flux is used to describe a thermal limit, where a phase change occurs during heating, such as vaporization at thermal contact surface when heating water. A critical heat flux may cause localised overheating of the heating surface. Overheating may be problematic with low weight paper for release liner, in particular with paper having grammage less than 50 g/m$^2$. When the temperature of the metal belt is high, the surface of the paper web may be overheated and damaged. To avoid overheating the paper web, the paper web is preferably heated such that the heat flux experienced by the paper web WEB1 during the residence time $\Delta t_{D1}$ is below the critical heat flux. Advantageously, the paper web WEB1 is heated such that the temperature of the paper web WEB1 remains below the boiling point of water at normal atmospheric pressure of 100° C. By having a temperature of the paper web below 100° C. on the press section and when supported by a belt BELT1 over the distance D1, overheating of the paper web WEB1 may be avoided. The drying section DSEC of a paper machine is designed for a paper web having a dry content in a given range. At the first separation point SP1, wherein the drying section begins, a paper web may typically have a dry content less than 40 wt.-%, such as in the range of 30 to 39 wt.-%. Advantageously, when heating the paper web WEB1 in the press section and while supporting on a belt BELT1 across the distance D1, a paper web having a dry content of equal to or higher than 40 wt.-%, such as equal to or higher than 42 wt.-%, preferably equal to or higher than 45 wt.-%, such as equal to or higher than 48 wt.-%, most preferably equal to or higher than 50 wt.-%, may be obtained.

At the first separation point SP1, the paper web dry content may be equal to or higher than 40 wt.-%, preferably equal to or higher than 45 wt.-%, and most preferably equal to or higher than 48 wt.-%. Advantageously, when having a temperature of the paper web WEB1 in the range of 56 to 99° C. while supported, a paper web having a dry content in the range of 40 wt.-% to 55 wt.-% is obtained at the first separation point SP1. When having a temperature of the paper web WEB1 equal to or higher than 85° C. while supported, a paper web having a dry content equal to or higher than 48 wt.-% may be obtained at the first separation point SP1. Increase in the temperature correlates with an increase in the percentage of water removed from the paper web before the drying section. In general, when a paper web reaches a dry content of 50 wt.-%, the paper web starts to shrink. By means of reduced refining and heat provided in the press section, a paper web dry content of a 50 wt.-% may be reached earlier. A higher dry content, when reached before providing web tension, reduces the above described negative effects of the drawing of the paper web WEB1 in machine direction.

Figure 3:
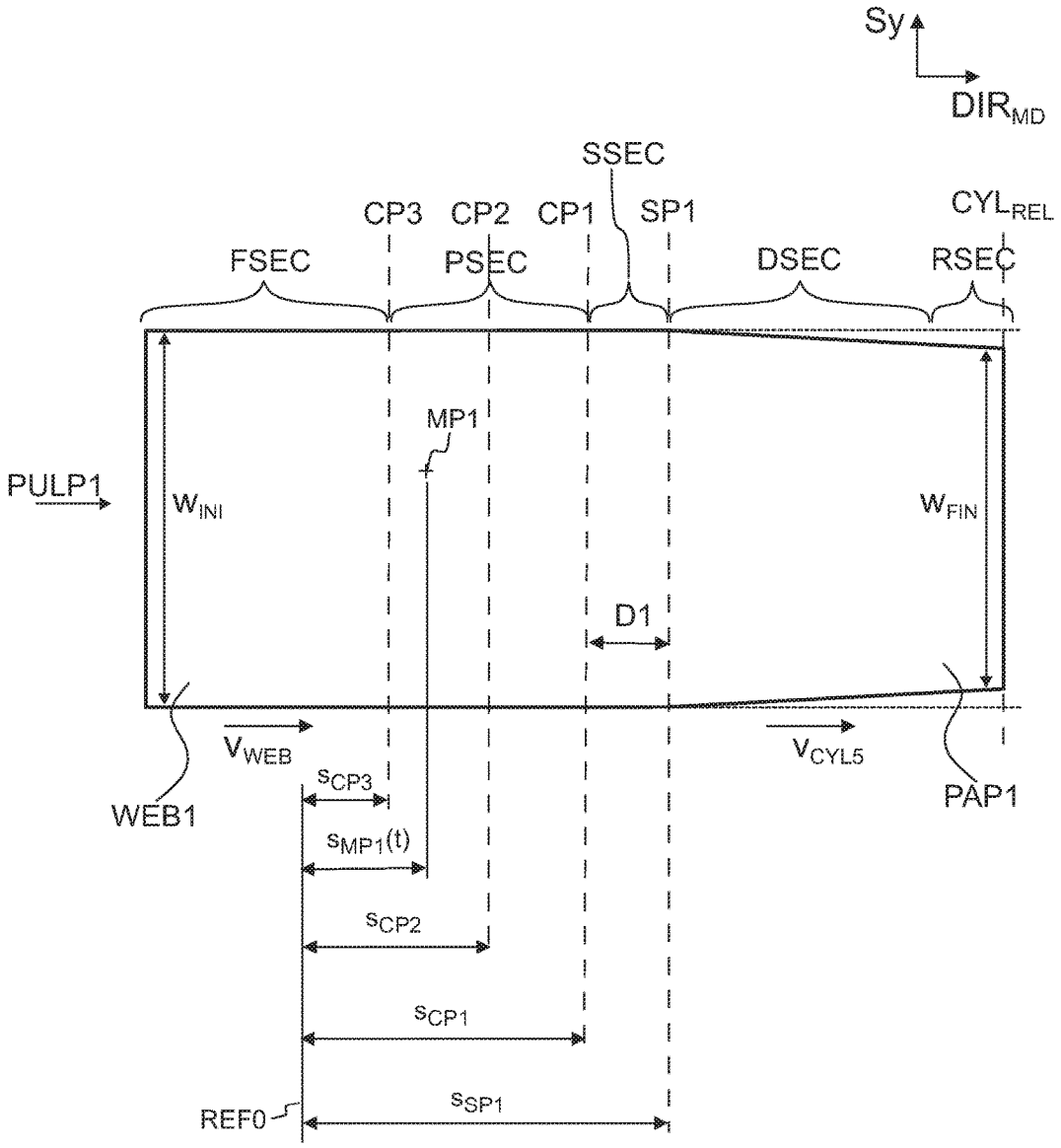
FIG. 3 illustrates, by way of an example, a top view of shrinkage behaviour in cross direction of a paper for release liner manufactured on a paper machine.

FIG. 3 illustrates, by way of an example, a top view of the shrinkage behaviour of paper web in cross direction on the paper machine. Paper web WEB1 for release liner is typically formed by introducing refined pulp PULP1 from a head box on a wire (not shown) on the forming section FSEC. The refined pulp has a Schopper-Riegler (SR) Freeness test value, as described above. The formed paper web WEB1 on the forming section FSEC has an initial width $W_{INI}$. The initial width $W_{INI}$ of the formed paper web WEB1 is typically a few meters, such as at least 1.5 meters. The initial width $W_{INI}$ of the formed paper web WEB1 may be several meters, for example in the range of 1.5 to 12.5 meters. The wire conveys the paper web WEB1 forward at a velocity $v_{WEB}$ in machine direction $DIR_{MD}$ on the paper machine. In the forming section FSEC water drains through the wire, the wire thus provides a first means to reduce the moisture content of the paper web WEB1 by gravity. The recovered water comprising pulp PULP1 residues may be returned back to the process, for example by using a short circulation of the paper machine. When forming paper web WEB1 suitable for use as a support layer of a release liner, the velocity $v_{WEB}$ of the paper web WEB1 on the paper machine may be high. MP1 may denote an arbitrary point of the moving web WEB1. The longitudinal position s of the point in the machine direction $DIR_{MD}$ may denote the length of the path between said point and a stationary reference point REF0, wherein said path is perpendicular to the transverse direction Sy, also denoted as the cross direction. The velocity $v_{WEB}$ may be equal to or above 600 meters per minute (meters/min), preferably at least 800 meters/min, most preferably at least 1000 meters/min, such as in the range of 600-1500 meters/min in the machine direction $DIR_{MD}$. A high velocity is preferable, when a more efficient production is desired. In the press section PSEC, between the third contact point CP3 and the first contact point CP1, the moisture content of the formed paper web WEB1 is reduced by means of heating and pressing, and the dry content of the formed paper web WEB1 increased. When a paper web WEB1 reaches a dry content of 50 wt.-%, the paper web WEB1 starts to shrink. When supporting the paper web WEB1 in the support section SSEC by a belt, the distance D1 defining the length of the support section SSEC from a first contact point CP1 in the press section PSEC to a first separation point SP1 on a drying section DSEC, and at the same time heating the paper web WEB1 such that the temperature of the paper web WEB1 is higher than or equal to 56° C., such as in the range of 56 to 99° C., a paper web WEB1 having a dry content equal to or higher than 40 wt.-% is obtained at the first separation point SP1. The amount of heat transferred may be used to control the dry content of the paper web at the first separation point SP1. The percentage of water removed from the paper web WEB1 before the drying section DSEC may be further controlled by first selecting the amount of refining of the pulp PULP1 before the forming section FSEC. The percentage of water removed from the paper web WEB1 before the drying section DSEC may be further controlled by heating the paper web WEB1 and by monitoring the temperature of the paper web WEB1 on the press section PSEC and the support section SSEC. By means of refining of the pulp PULP1 less, and/or by means of heating the paper web WEB1 in the press section PSEC, a paper web WEB1 dry content of at least 40 wt.-%, preferably in the range of 40 wt.-% to 55 wt.-%, may be reached at the first separation point SP1. The higher dry content at the first separation point SP1 reached such that the paper has been supported from the forming section to the first separation point SP1 reduces the shrinkage of the paper web WEB1 in the drying section DSEC in cross direction perpendicular to the machine direction $DIR_{MD}$. The support section SSEC comprising the belt also reduces the need to draw the paper web WEB1 in machine direction $DIR_{MD}$. By supporting the paper web WEB1 from the first contact point CP1 in the press section PSEC to the first separation point SP1 on a drying section DSEC less tension is needed on the paper web in machine direction. Therefore the velocity $v_{WEB}$ of the paper web WEB1 may be increased. Supporting the paper web WEB1 across the distance D1 therefore allows transferring the paper web WEB1 over the distance D1 such that a difference between the second circumferential velocity $v_{CYL5}$ in the drying section DSEC and the first circumferential velocity $v_{CYL3}$ in the press section PSEC is less than 4% between the first contact point CP1 and the first separation point SP1. The paper web WEB1 velocity $v_{WEB}$ on the forming section FSEC may be equal to the first velocity $v_{CYL3}$.

Accordingly, a method to manufacture low weight high quality paper for release liner may comprise rotating a roll (CYL3) at the first contact point (CP1) at a first velocity ($v_{CYL3}$), and rotating a roll (CYL5) at the first separation point (SP1) at a second velocity ($v_{CYL5}$) higher than the first velocity ($v_{CYL3}$), such that the difference between the second velocity ($v_{CYL5}$) and the first velocity ($v_{CYL3}$) is less than 4%, preferably less than 3.5% of the first velocity ($v_{CYL3}$).

The higher dry content provides means to increase the velocity $v_{WEB}$ of the paper web WEB1 by several percents. This increases the paper production. The increase in the velocity $v_{WEB}$ of the paper web WEB1 may be, for example at least 2%, such as in the range of 2 to 20%, without significant negative effects to the density of the paper surface, in regard of applying a release coating. When the paper web WEB1 is heated while being supported, the difference between the first velocity $v_{CYL3}$ and the second velocity $v_{CYL5}$ may be smaller, such as equal to or less than 3.8%, preferably equal to or less than 3.5%, most preferably equal to or less than 3.2%. The difference between the first velocity $v_{CYL3}$ and the second velocity $v_{CYL5}$ may be, for example, in the range of 1 to 3.8%, preferably in the range of 1.2 to 3.5%, most preferably in the range of 1.5 to 3.2%.

At the reeling section RSEC, when reeling the paper PAP1 formed from the paper web WEB1 on a paper roll $CYL_{REL}$, the paper PAP1 has a final width $W_{FIN}$. The shrinkage of the paper web WEB1 during manufacturing of paper PAP1 may be determined as a relative shrinkage $\Delta w/w_{INI}$ between an initial width $W_{INI}$ of the paper web WEB1 and a final width $W_{FIN}$ width of the paper PAP1. When using a manufacturing method for paper suitable for use as a support layer of a release liner as described above, the shrinkage denotes the relative shrinkage $\Delta w/w_{INI}$ between the initial width $W_{INI}$ of the paper web WEB1 at the first nip of the press section PSEC denoted by contact point CP3, and the final width $W_{FIN}$ width of the paper PAP1 on the paper roll $CYL_{REL}$ at the reeling section RSEC in cross direction. The shrinkage of the paper web WEB1 in the cross direction is less than 6%, preferably less than 5%, most preferably less than 4%.

The above-described method for manufacturing paper suitable for use as a support layer of a release liner provides means to obtain paper web having a dry content of equal to or higher than 40 wt.-% at a first separation point denoting the beginning of the drying section. The method provides means for reducing moisture content of the paper web in the press section and while supporting the paper in the support section. In the method, pulp slurry from chemical pulp having a Schopper Riegler (SR) Freeness value equal to or less than 50 after refining may be used. When heating the belt as described, a Schopper Riegler (SR) Freeness value equal to or less than 45, such as in the range of 29 to 50, preferably in the range of 30 to 45 may be used. A reduce in the level of refining, as described above, combined with the reduced drawing of the web across the support section, produces paper having less shrinkage in machine direction and in cross direction, and a smooth surface with high density suitable for use as a support layer of a release liner. A higher dry content reached already before the drying section, combined with a higher temperature of equal to or higher than 56° C., preferably equal to or higher than 60° C., in the support section reduces condensation and formation of stains on the paper web in the drying section as well. The higher dry content of the paper web at the beginning of the drying section also enables a more efficient cylinder drying with steam. The increased water removal in the press section and reduced refining when forming pulp slurry provide means to reduce the energy consumption, as less refining, less drying, and less calendering may be needed.

A low weight paper suitable for use as a support layer of a release liner, in this context refers to paper, preferably glassine paper, which after a calendering treatment has a final thickness of less than less than 100 micrometers, preferably less than 80 micrometers, most preferably equal to or less than 65 micrometers. A low weight paper may have a thickness in the range of 35 to 95 micrometers, preferably in the range of 36 to 70 micrometers, most preferably in the range of 50 to 65 micrometers. A low weight paper, in this context, further refers to a release liner substrate layer, which has a primer layer coating, wherein the coating is applied on the surface of the primer layer in an amount equal to or less than 10 $g/m^2$, such as in the range of 1 to 10 $g/m^2$ per side. The paper support layer comprises a first and a second side. The grammage of the paper may be equal to or less than 78 $g/m^2$, such as in the range of 30 to 78 $g/m^2$. Preferably, the grammage of a low weight paper is equal to or less than 60 $g/m^2$, such as in the range of 38 to 60 $g/m^2$. Most preferably the grammage of a low weight paper is equal to or less than 50 $g/m^2$, such as in the range of 39 to 50 $g/m^2$. Typical thickness and grammage values for a paper suitable for use as a support layer of a release liner are, for example, a paper having a grammage of 45 $g/m^2$ and a thickness of 43 micrometers, a paper having a grammage of 60 $g/m^2$ and a thickness of 53 micrometers, or a paper having a grammage of 78 $g/m^2$ and a thickness of 68 micrometers. The effects of heating and web tension to the mechanical properties of the paper are more prominent in low weight paper suitable for use as a support layer of a release liner.

Further benefit of the method described above is, that the improved dimensional stability and surface with high density provides means to reduce the amount of raw materials used in a primer layer coating, which is applied on the paper web or paper surface after drying. Further still, the improved dimensional stability and surface with high density provides means to reduce the amount of calendering for obtaining a desired end thickness for the paper. Due to the surface with improved density, the calendering may be done for a paper having reduced moisture content. The calendering may be done either off-line or on-line. An off-line calender provides means for increasing the paper web velocity $v_{WEB}$, as one or more calenders may be arranged in a parallel manner to increase the calendering capacity. Due to the high paper web velocity $v_{WEB}$ obtainable by the manufacturing process, however, also on-line calender having sufficient velocity is made possible.

Figure 4:
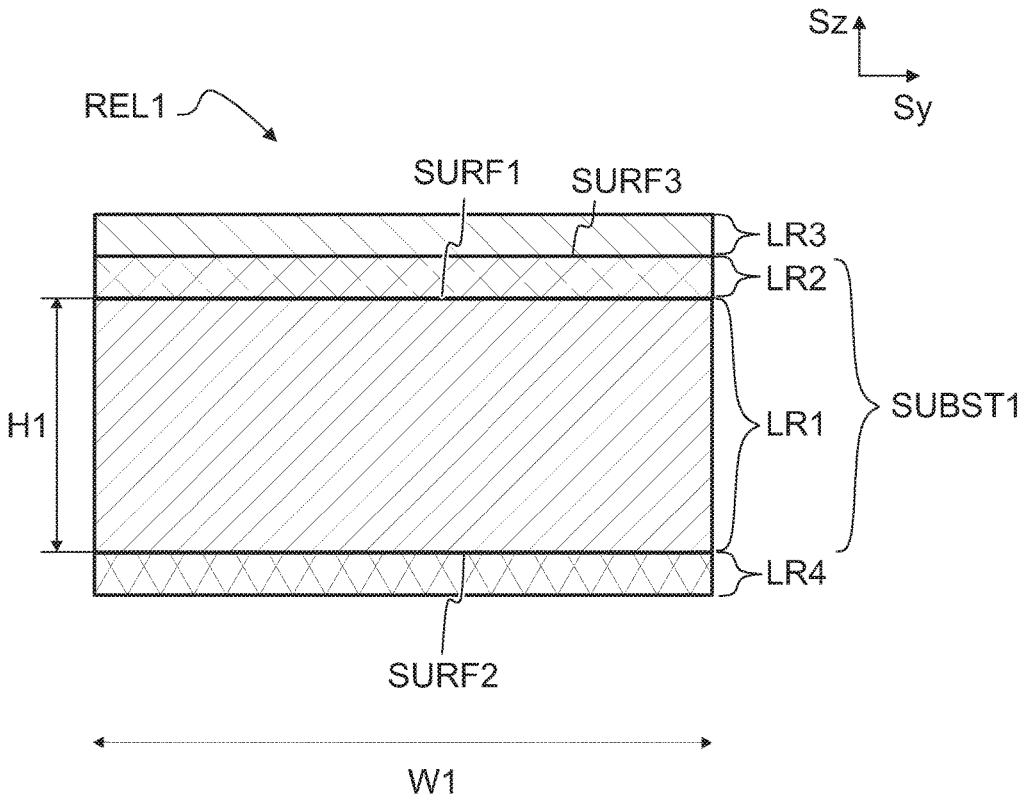
FIG. 4 illustrates, by way of an example, a structure of a release liner.

FIG. 4 illustrates, by way of an example, a structure of a release liner REL1. A release liner REL1 comprises a substrate layer SUBST1 consisting of a support layer LR1 and a primer layer LR2. The support layer LR1 is paper manufactured from chemically treated wood pulp, which has been refined in order to obtain a smooth surface having high density. The thickness H1 of the support layer, after calendering treatment, is typically in the range of less than 100 micrometers, such as in the range of 35 to 95 micrometers, preferably in the range of 50 to 65 micrometers. Typically, the width W1 of a release liner REL1, which is the dimension parallel to cross direction of the paper web, is in the range of 1.5 to 12 meters, when reeled to a reeling roll from a paper machine, before or after a calendering treatment. The width W1 when reeled depends on the width of the reeling roll. The width W1 may be adjusted by slitting, to suit desired end user applications. Slitting may be referred to as trimming. Depending of the application, the width W1 of the release liner REL1, may vary, and a width W1 in the range of a few centimeters to half a meter or even several meters, up to the initial width of the reeled release liner REL1 may be provided. The length of a release liner, which is the direction in machine direction of the paper web, may be up to several kilometers. The length may be adjusted by cutting, to suit desired end user applications. A primer layer LR2 has been applied on the support layer LR1. The primer layer LR2 may be provided on at least a first surface SURF1, or on both a first surface SURF1 and a second surface SURF2, of the support layer LR1. The purpose of the primer layer LR2 is to improve the functionality of the substrate layer SUBST1. The primer layer LR2 may, for example comprise additives to further increase the surface tightness. Furthermore, the primer layer LR2 may comprise one or more compounds increasing the compatibility of the primer layer LR2 with a top layer LR3. The top layer LR3 is formed by applying a release coating on the primer layer LR2. The release coating LR3 may be attached on a substrate layer surface SURF3. For example, the release coating may contain a silicon polymer comprising functional vinyl groups, which may be cross-linkable with ultra-violet radiation or heat. In addition, the primer layer LR2 may comprise functional vinyl groups, which may be used to improve the anchorage of the release coating to the primer layer LR2. When the primer layer LR2 is provided only on the first surface SURF1 of the support layer LR1, the second surface SURF2 of the support layer LR1 may be coated with a barrier layer LR4. The barrier layer LR4 may be, for example a composition comprising starch, calcium carbonate, mica, alginate and/or other binder material. A barrier layer LR4 is typically provided to reduce or eliminate dusting of the support layer LR1 surface on a release liner REL1.

Figure 5:
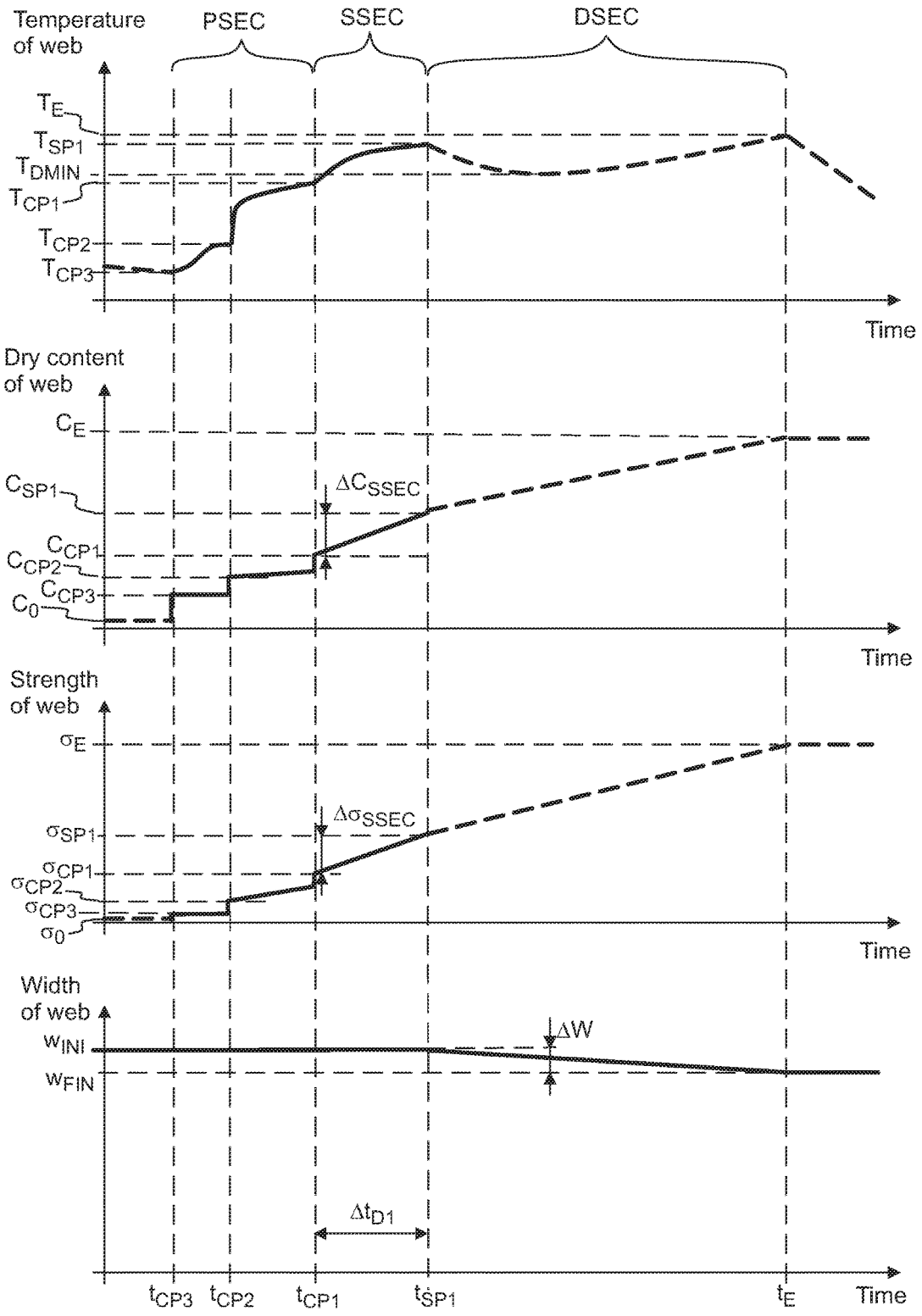
FIG. 5 illustrates, by way of an example, process parameters and parameter values as a function of time in a manufacturing process of a paper suitable for use as a support layer of a release liner.

FIG. 5 illustrates, by way of example, the evolution of temperature of the paper web WEB1, the evolution of dry content of the paper web WEB1, the evolution of tensile strength of the paper web WEB1, and the evolution of the width of the paper web WEB1 when the web propagates via the press section PSEC, via the support section SSEC, and via the drying section DSEC.

MP1 may denote an arbitrary point of the moving web WEB1 (see FIG. 3). The point MP1 moves at the velocity of the web WEB1. The uppermost curve of FIG. 1 shows the evolution of temperature of the moving point MP1. The second curve from the top of FIG. 5 shows the evolution of dry content of the moving point MP1. The third curve from the top of FIG. 5 shows the evolution of tensile strength of the web at the moving position of the point MP1. The lowermost curve of FIG. 5 shows evolution of the width of the web WEB1 at the moving position of the point MP1.

The moving point MP1 may leave the first nip of the press section PSEC denoted as the contact point CP3 at a time $t_{CP3}$. The moving point MP1 may leave a second nip of the press section PSEC denoted as the contact point CP2 at a time $t_{CP2}$. The moving point MP1 may leave a third nip of the press section PSEC denoted as the contact point CP1 at a time $t_{CP1}$. The web WEB1 may be separated from the BELT1 at the separation point SP1. The position of the moving point MP1 may coincide with the separation point SP1 at the time $t_{SP1}$. The moving point MP1 may leave the drying section DSEC at the time $t_E$.

Referring to the uppermost curve of FIG. 5, the point MP1 may have a temperature $T_{CP3}$ at the time $t_{CP3}$, a temperature $T_{CP2}$ at the time $t_{CP2}$, a temperature $T_{CP1}$ at the time $t_{CP1}$, a temperature $T_{CP1}$ at the time $t_{SP1}$ and a temperature $T_E$ at the time $t_E$. In an embodiment, the web may be heated such that temperature of the web WEB1 is non-decreasing between the first nip of the press section PSEC and the first separation point SP1 in the drying section DSEC. The web WEB1 may be heated at least in the support section SSEC such that $T_{CP3} \leq T_{CP2} \leq T_{CP1} \leq T_{SP1} \leq T_E$. In an embodiment, the web WEB1 may be heated in the press section PSEC and in the support section SSEC such that $T_{CP3} \leq T_{CP2} \leq T_{CP1} \leq T_{SP1} \leq T_E$. In an embodiment, the web may be heated such that $T_{CP3} < T_{CP2} < T_{CP1} < T_{SP1} < T_E$. The time period $\Delta t_{D1}$ is equal to the residence time, which is the time period the paper web WEB1 is supported by the belt BELT1 between time point $t_{CP1}$ and time point $t_{SP1}$. In an embodiment, the temperature difference $T_{SP1} - T_{CP1}$ may be in the range of 0 to 20° C., wherein the temperature $T_{CP1}$ at the time $t_{CP1}$ may be equal to or higher than 56° C., preferably equal to or higher than 60° C. In an embodiment, the temperature difference $T_{CP3} - T_{SP1}$ may be in the range of 0 to 45° C. When the lower limit (i.e minimum temperature) of temperature $T_{CP3}$ at the time point $t_{CP3}$ is 45° C., the temperature difference $T_{CP3} - T_{SP1}$ may be in the range of 11 to 54° C., such that the minimum temperature of the web WEB1 in the support section SSEC at time point $t_{SP1}$ is in the range of 56° C. to 99° C. When the upper limit (i.e maximum temperature) of temperature $T_{CP3}$ at the time point $t_{CP3}$ is 55° C., the temperature difference $T_{CP3} - T_{SP1}$ may be in the range of 1 to 44° C., such that the maximum temperature of the web WEB1 in the support section SSEC at time point $t_{SP1}$ is in the range of 56° C. to 99° C.

The maximum temperature of the web WEB1 in the support section SSEC may be e.g. in the range of 56° C. to 99° C., i.e. the web WEB1 supported by the belt BELT1 may be heated such the maximum temperature of the web WEB1 remains below the boiling point of water.

Referring to the second curve from the top in FIG. 5, the dry content of the web WEB1 may be increased by pressing and/or heating the web WEB1. The web WEB1 entering the pressing section PSEC may have a dry content $C_0$. The moving point MP1 may have a dry content $C_{CP3}$ at the time $t_{CP3}$, a dry content $C_{CP2}$ at the time $t_{CP2}$, a dry content $C_{CP1}$ at the time $t_{CP1}$, a dry content $C_{CP1}$ at the time $t_{SP1}$, and a dry content $C_E$ at the time $t_E$.

The dry content of the web WEB1 may be rapidly increased at each pressing nip CP3, CP2, CP1. The dry content of the web WEB1 may be increased by heating the web WEB1 between the second contact point CP2 and the first contact point CP1. The dry content of the web WEB1 may be increased by heating the web WEB1 with the belt BELT1 between the second contact point CP2 and the first contact point CP1. The dry content of the web WEB1 may be increased during heating the web WEB1 in the support section. The dry content of the web WEB1 may be increased by heating the web WEB1 with the belt BELT1 between the first contact point CP1 and the separation point SP1. The moving point MP1 may move from the first contact point CP1 and the separation point SP1 during the time period $\Delta t_{D1}$. $\Delta C_{SSEC}$ may denote a change of the dry content of the web WEB1 at the moving point MP1 during the time period $\Delta t_{D1}$.

Referring to the third curve from the top in FIG. 5, the tensile strength of the web WEB1 may be increased when the web WEB1 propagates through the press section PSEC and the support section. The web WEB1 entering the pressing section PSEC may have a tensile strength $\sigma_0$. The moving point MP1 may have a tensile strength $\sigma_{CP3}$ at the time $t_{CP3}$, a tensile strength $\sigma_{SP2}$ at the time $t_{CP2}$, a tensile strength $\sigma_{CP1}$ at the time $t_{CP1}$, a tensile strength $\sigma_{SP1}$ at the time $t_{SP1}$, and a tensile strength $\sigma_{SPE}$ at the time $t_{SPE}$. $\Delta\sigma_{SSEC}$ may denote the change of tensile strength of the web WEB1 at the moving point MP1 during the time period $\Delta t_{D1}$. Evaporation of water away from the web WEB1 in the support section SSEC may substantially increase the tensile strength of the web WEB1.

The lowermost curve of FIG. 5 shows evolution of the width of the web WEB1. The web WEB1 at the first nip of the press section may have an initial width $w_{INI}$. The width of the paper roll at the reeling section, after the drying section DSEC, may have a final width $w_{FIN}$. The width of the web WEB may be reduced in the drying section DSEC1 due to shrinkage in the cross direction caused by evaporation of water away from the web in the drying section DSEC. $\Delta w$ may denote the difference $w_{INI}-w_{FIN}$. The relative shrinkage $\Delta w/w_{INI}$ may be e.g. smaller than or equal to 4%. The shrinkage in the cross direction of the web WEB1 may take place mainly in the drying section DSEC, i.e. after the web WEB1 has been separated from the belt BELT1.

The dry content of the web WEB1 at the separation point SP1 may be increased by supporting and heating the web WEB1 with the belt BELT1. Thanks to the increased dry content at the separation point SP1, the relative shrinkage $\Delta w/w_{INI}$ in the drying section DSEC may be low. Consequently, the final width $w_{FIN}$ of the web WEB1 may be increased without increasing the axial length of the rolls of the press section PSEC. The axial length refers to the length of the rolls in the cross direction of the paper web WEB1.

The curves of FIG. 5 may also be interpreted to represent temporally averaged properties at different parts of the web WEB1. In stationary conditions, the temporally averaged properties of the web WEB1 at a given stationary point may be substantially equal to the corresponding instantaneous properties of the moving point MP1. For example, the instantaneous temperature of the moving point MP1 at the separation point SP1 at the time $t_{SP1}$ may be substantially equal to the temporally averaged temperature of the web WEB1 at the separation point SP1.

In stationary conditions, the temperature of the web WEB1 at the separation point SP1 may be substantially equal to $T_{SP1}$, the dry content of the web WEB1 at the separation point SP1 may be substantially equal to $C_{SP1}$, and the tensile strength of the web WEB1 at the separation point SP1 may be substantially equal to $\sigma_{SP1}$.

In stationary conditions, the temperature of the web WEB1 at the contact point CP1 may be substantially equal to $T_{CP1}$, the dry content of the web WEB1 at the contact point CP1 may be substantially equal to $C_{CP1}$, and the tensile strength of the web WEB1 at the contact point CP1 may be substantially equal to $\sigma_{CP1}$.

Figure 6:
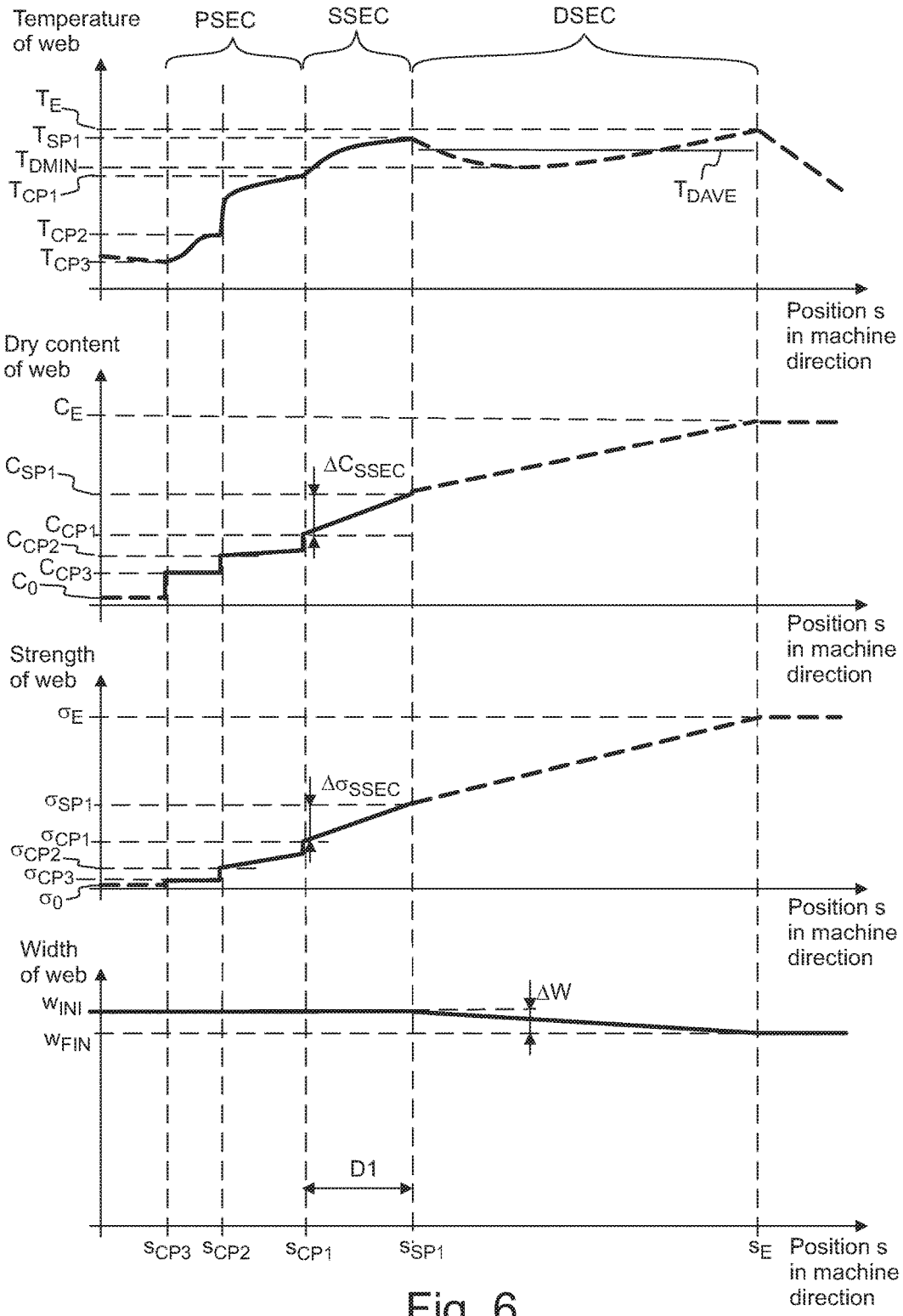
FIG. 6 illustrates, by way of an example, process parameters and parameter values as a function of position in machine direction in a manufacturing process of a paper suitable for use as a support layer of a release liner.

FIG. 6 illustrates, by way of example, the longitudinal temperature distribution of the paper web WEB1, the dry content of the paper web WEB1 at different positions of the web, the tensile strength of the paper web WEB1 at different positions of the web, and the width of the web WEB1 at different longitudinal positions when the web propagates via the press section PSEC, via the support section SSEC, and via the drying section DSEC.

The uppermost curve of FIG. 6 shows the temperature of the web WEB1 as the function of the longitudinal position s in the machine direction $DIR_{MD}$. The second curve from the top of FIG. 6 shows the dry content of the web as the function of the position s. The third curve from the top of FIG. 6 shows the tensile strength of the web of the position s. The lowermost curve of FIG. 6 shows the width of the web WEB1 as the function of the position s.

Referring back to FIG. 3, the longitudinal position s of a point in the machine direction $DIR_{MD}$ may denote the length of the path between said point and a stationary reference point REF0, wherein said path is perpendicular to the transverse direction Sy. The position $s_{REF}$ of the stationary reference point REF0 is zero (i.e. $s_{REF}=0$). The stationary reference point REF0 may coincide e.g. with a stationary point of the paper machine. The stationary reference point REF0 may coincide e.g. with the first nip of the press section PSEC. The path may comprise one or more linear parts and/or one or more curved paths. $s_{CP3}$ denotes the position of the third contact point CP3. More precisely, $s_{CP3}$ may denote the position where the web WEB1 leaves the first nip of the press section PSEC. $s_{CP2}$ denotes the position of the second contact point CP2. More precisely, $s_{CP2}$ may denote the position where the web WEB1 leaves a second nip of the press section PSEC. $s_{CP1}$ denotes the position of the first contact point CP1. More precisely, $s_{CP1}$ may denote the position where the web WEB1 leaves a third nip of the press section PSEC. $s_{SP1}$ denotes the position of the separation point SP1, and $s_E$ denotes the position of the end of the drying section DSEC. The positions $s_{CP1}$ and the $s_{SP1}$ are separated by the distance D1. The positions $s_{CP3}$, $s_{CP2}$, $s_{CP1}$, $s_E$ are stationary. The position $s_{SP1}$ of the separation point SP1 may slightly fluctuate so that the position $s_{SP1}$ of the separation point SP1 may be substantially stationary. The position $s_{MP1}$ of the moving point MP1 of the web WEB1 moves at the velocity of the WEB1. The position of the moving point MP1 may be expressed as a function $s_{MP1}(t)$ of time t.

Referring to the uppermost curve of FIG. 6, the web WEB1 may have a temperature $T_{CP3}$ at the position $s_{CP3}$. The web WEB1 may have a temperature $T_{CP2}$ at the position $s_{CP2}$. The web WEB1 may have a temperature $T_{CP1}$ at the position $s_{CP1}$. The web WEB1 may have a temperature $T_{SP1}$ at the position $s_{SP1}$, i.e. at the separation point SP1. The web WEB1 may have a temperature $T_E$ at the position $s_E$, i.e. at the end of the drying section.

$T_{DMIN}$ denotes the minimum temperature of the web WEB1 in the drying section DSEC. In an embodiment, the temperature $T_{DMIN}$ may be substantially lower than the maximum temperature of the WEB1 in the support section SSEC. In an embodiment, the temperature $T_{DMIN}$ may be substantially lower than the temperature $T_{SP1}$ of the WEB1 at the separation point SP1. The temperature $T_{DMIN}$ may be at least temporally lower than the temperature $T_{SP1}$, for example, due to the evaporating moisture and air flow between drying cylinders, when the paper web WEB1 is not in thermal contact with a drying cylinder.

In an embodiment, the web may be heated such that temperature of the web WEB1 is a non-decreasing function of the position s between the first nip of the press section PSEC and the first separation point SP1 in the drying section DSEC. The web WEB1 may be heated at least in the support section SSEC such that $T_{CP2} \leq T_{CP1} \leq T_{SP1}$. In an embodiment, the web WEB1 may be heated in the press section PSEC and in the support section SSEC such that $T_{CP3} \leq T_{CP2} \leq T_{CP1} \leq T_{SP1}$. In an embodiment, the web WEB1 may be heated in the press section PSEC, in the support section SSEC, and in the drying section DSEC such that $T_{CP3} \leq T_{CP2} \leq T_{CP1} \leq T_{SP1} \leq T_E$. In an embodiment, the web WEB1 may be heated in the press section PSEC, in the support section SSEC, and in the drying section DSEC such that $T_{CP3} \leq T_{SP2} \leq T_{CP1} \leq T_{SP1} \leq T_E$, and $T_{DMIN} < T_{SP1}$. The temperature difference $T_{SP1} - T_{CP1}$ may be e.g. in the range of 0 to 20° C., wherein the temperature $T_{CP1}$ may be equal to or higher than 56° C. The temperature difference $T_{CP3} - T_{SP1}$ may be e.g. in the range of 0 to 43° C. When the lower limit (i.e minimum temperature) of temperature $T_{CP3}$ is 45° C., the temperature difference $T_{CP3} - T_{SP1}$ may be e.g. in the range of 11° C. to 54° C., such that the minimum temperature of the web WEB1 in the support section SSEC is in the range of 56° C. to 99° C. When the upper limit (i.e maximum temperature) of temperature $T_{CP3}$ is 55° C., the temperature difference $T_{CP3} - T_{SP1}$ may be in the range of 1° C. to 44° C., such that the maximum temperature of the web WEB1 in the support section SSEC is in the range of 56° C. to 99° C.

The maximum temperature of the web WEB1 in the support section SSEC may be e.g. in the range of 56° C. to 99° C., preferably in the range of 60° C. to 99° C. In other words, the web WEB1 supported by the belt BELT1 may be heated such the maximum temperature of the web WEB1 in the portion supported by the belt BELT1 remains below the boiling point of water.

Referring to the second curve from the top in FIG. 6, the dry content of the web WEB1 may be increased by pressing and/or heating the web WEB1. The web WEB1 entering the pressing section PSEC may have a dry content $C_0$. The web may have a dry content $C_{CP3}$ at the position $s_{CP3}$, a dry content $C_{CP2}$ at the position $s_{CP2}$, a dry content $C_{CP1}$ at the position $s_{CP1}$, a dry content $C_{SP1}$ at the position $s_{SP1}$, and a dry content at the position $s_E$. The dry content of the web WEB1 may be rapidly increased at each pressing nip CP3, CP2, CP1. The dry content of the web WEB1 may be increased by heating the web WEB1 between the second contact point CP2 and the first contact point CP1. The dry content of the web WEB1 may be increased by heating the web WEB1 with the belt BELT1 between the second contact point CP2 and the first contact point CP1. The dry content of the web WEB1 may be increased during heating the web WEB1 in the support section SSEC. The dry content of the web WEB1 may be increased by heating the web WEB1 with the belt BELT1 between the first contact point CP1 and the separation point SP1. $\Delta C_{SSEC}$ may denote a change of the dry content of the web WEB1 between the positions $s_{CP1}$ and $s_{SP1}$.

Referring to the third curve from the top in FIG. 6, the tensile strength of the web WEB1 may be increased when the web WEB1 propagates through the press section PSEC and the support section SSEC. The web WEB1 entering the pressing section PSEC may have a tensile strength $\sigma_0$. The web may have a tensile strength $\sigma_{CP3}$ at the position $s_{CP3}$. The web may have a tensile strength $\sigma_{CP2}$ at the position $s_{CP2}$. The web may have a tensile strength $\sigma_{CP1}$ at the position $s_{CP1}$. The web may have a tensile strength $\sigma_{SP1}$ at the position $s_{SP1}$. The web may have a tensile strength $\sigma_E$ at the position $s_E$. $\Delta\sigma_{SSEC}$ may denote the change of tensile strength of the web WEB1 in the support section SSEC. Supporting the paper web by a belt in the support section SSEC may substantially increase the tensile strength of the web WEB1. Evaporation of water away from the web WEB1 in the support section SSEC may further substantially increase the tensile strength of the web WEB1. Reduced drawing of the paper web in the support section SSEC may further substantially increase the tensile strength of the web WEB1.

The lowermost curve of FIG. 6 shows evolution of the width of the web WEB1. The web WEB1 entering the first nip of the press section may have an initial width $w_{INI}$ at the position $s_{CP3}$. The width of the paper roll at the reeling section, after the drying section DSEC, may have a final width $w_{FIN}$ at the position $s_E$. The width of the web WEB1 may be reduced in the drying section DSEC due to shrinkage in the cross direction caused by evaporation of water away from the web in the drying section DSEC. $\Delta w$ may denote the difference $w_{INI}$-$w_{FIN}$. The relative shrinkage $\Delta w/w_{INI}$ may be e.g. smaller than or equal to 4%. The shrinkage in the cross direction Sy of the web WEB1 may take place mainly in the drying section DSEC, i.e. after the web WEB1 has been separated from the belt BELT1.

The dry content $C_{SP1}$ of the web WEB1 at the separation point SP1 may be increased by supporting and heating the web WEB1 with the belt BELT1. Thanks to the increased dry content $C_{SP1}$ at the separation point SP1, the relative shrinkage $\Delta w/w_{INI}$ in the drying section DSEC may be low. Consequently, the final width $w_{FIN}$ of the web WEB1 may be increased without increasing the axial length of the rolls of the press section PSEC. The axial length refers to the length of the rolls in the cross direction of the paper web WEB1.

The drying section DSEC may have an average temperature $T_{DAVE}$. More precisely, the temperature $T_{DAVE}$ may denote the spatially averaged temperature of the web WEB1 between the positions $s_{SP1}$ and $S_E$. Thanks to the increased dry content $C_{SP1}$ at the separation point SP1, the average temperature $T_{DAVE}$ of the drying section DSEC may be decreased and/or the length of the drying section DSEC may be reduced. The reduced average temperature $T_{DAVE}$ and/or length may substantially reduce the heating power required for heating the drying section DSEC. The reduction of heating power in the drying section DSEC may be greater than the increase of heating power needed to reach the increased dry content $C_{SP1}$. Thanks to increasing the dry content in the support section SSEC, the total energy consumption of the paper machine per unit mass of produced paper may be substantially reduced.

Thanks to increasing the dry content in the support section SSEC, the average temperature $T_{DAVE}$ of the drying section DSEC may be decreased and/or the length of the drying section DSEC may be reduced. This may facilitate controlling the operation of the drying section DSEC. In an embodiment, the number of heated rolls of the drying section DSEC may be reduced.

Figure 7:
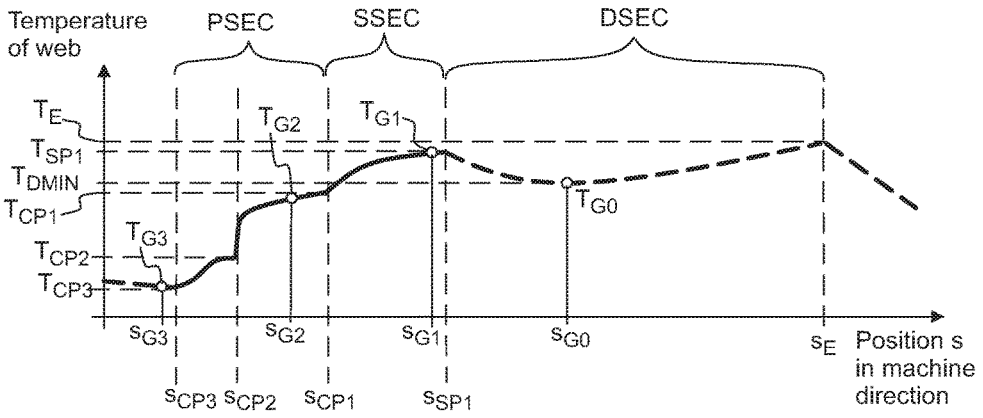
FIG. 7 illustrates, by way of an example, the temperature of the paper web as a function of position in machine direction in a manufacturing process of a paper suitable for use as a support layer of a release liner.

Referring to FIG. 7, the temperature of the moving web WEB1 may be measured at various monitoring positions $s_{G0}$, $s_{G1}$, $s_{G2}$, $s_{G3}$ e.g. by using an optical temperature sensor. The monitoring position $s_{G3}$ may be located before the first nip of the press section PSEC. The monitoring position $s_{G2}$ may be located between the first contact point CP1 and the second contact point CP2 in the press section PSEC. The monitoring position $s_{G1}$ may be located in the support section SSEC, between the first contact point CP1 and the first separation point SP1. The monitoring position $s_{G0}$ may be located in the drying section DSEC. $T_{G0}$ may denote the measured temperature of the web WEB1 at the position $s_{G0}$.

$T_{G1}$ may denote the measured temperature of the web WEB1 at the position $s_{G1}$. $T_{G2}$ may denote the measured temperature of the web WEB1 at the position $s_{G2}$. $T_{G3}$ may denote the measured temperature of the web WEB1 at the position $s_{G0}$.

In an experimental test run, the following temperature values were measured when the web WEB1 was moving: $T_{G0}$=58.3° C., $T_{G1}$=77.4° C., $T_{G2}$=63.0° C., $T_{G3}$=56.3° C. These measured values were obtained by temporal and spatial averaging. For example, the value $T_{G1}$=77.4° C. was obtained by measuring a group of temperature values at the longitudinal position $s_{G1}$, and by averaging the values of said group in the transverse direction Sy. In this example case, $T_{G1}$ was higher than $T_{G2}$, and $T_{G2}$ was higher than $T_{G3}$ (i.e. $T_{G3}<T_{G2}<T_{G1}$). This set of operating temperatures ($T_{G3}$, $T_{G2}$, $T_{G1}$) may indicate an operating condition where the temperature of the web is non-decreasing in the press section PSEC and in the support section SSEC. In an embodiment, the paper machine may be operated such that $T_{G1}$ is higher than $T_{G2}$, and $T_{G2}$ is higher than $T_{G3}$. In the experimental test run, the measured temperature $T_{G0}$ in the drying section DSEC was 58.3° C., and the measured temperature $T_{G1}$ in the support section SSEC was 77.4° C. In this example case, $T_{G1}$ was higher than $T_{G0}$, i.e. the temperature $T_{G0}$ in the drying section DSEC was lower than the temperature $T_{G1}$ measured in the support section SSEC. In this example case, the temperature difference $T_{G1}$-$T_{G0}$ was approximately equal to 19° C. In an embodiment, the paper machine may be operated such that $T_{G1}$ is higher than $T_{G0}$. The paper machine may be operated such that the difference $T_{G1}$-$T_{G0}$ is greater than 5° C., greater than 10° C., or even greater than 15° C. The temperature $T_{G0}$ may be temporally lower than the temperature $T_{G1}$, for example, due to the evaporating moisture and air flow between drying cylinders in the drying section, when the paper web WEB1 is not in thermal contact with a drying cylinder. In an embodiment, $T_{G1}$ may be substantially higher than $T_{G0}$, i.e. the temperature $T_{G0}$ in the drying section DSEC may be higher than the temperature $T_{G1}$ measured in the support section SSEC. In an embodiment, the temperature profile of the paper web WEB1 in the drying section between the positions $s_{SP1}$ and $S_E$ may be non-decreasing, such that the drying section DSEC may have an average temperature $T_{DAVE}$, which is equal to or higher than $T_{G1}$ and/or equal to or higher than $T_{SP1}$.

In the experimental test run, the measured temperature $T_{G1}$ in the support section SSEC was in the range of 56° C. to 99° C. In the experimental test run, the measured temperature $T_{G2}$ in the press section PSEC was also in the range of 56° C. to 99° C. The paper machine may be operated such that the measured temperature $T_{G1}$ in the support section SSEC is in the range of 56° C. to 99° C.

Referring back to FIG. 2, a temperature sensor G0 may be at least temporarily arranged to measure the temperature $T_{G0}$ at the position $s_{G0}$. A temperature sensor G1 may be at least temporarily arranged to measure the temperature $T_{G1}$ at the position $s_{G1}$. A temperature sensor G2 may be at least temporarily arranged to measure the temperature $T_{G2}$ at the position $s_{G2}$. A temperature sensor G3 may be at least temporarily arranged to measure the temperature $T_{G3}$ at the position $s_{G0}$. The temperature sensors G1, G2, G3, G4 may be different sensors, or the same sensor may be temporarily moved to different positions in order to measure the temperatures $T_{G0}$, $T_{G1}$, $T_{G2}$, $T_{G3}$. The temperature sensor or sensors G1, G2, G3, G4 may be e.g. arranged to measure the temperature of the web e.g. by monitoring the intensity of infrared radiation emitted from the paper web WEB1.

The temperatures in the experimental runs above were measured using an optical temperature sensor. Preferably, a non-contact infrared sensor suitable for measuring release paper manufacturing process temperatures is used. An example of such non-contact infrared sensor is Fluke 62 Mini Infrared Thermometer Gun. When using such optical temperature sensor, the temperature $T_{SP1}$ of the paper web WEB1 at the first separation point SP1 and/or the temperature $T_{CP1}$ of the paper web WEB1 at first contact point CP1 may be measured by means of the monitoring position $s_{G1}$ located in the support section SSEC, between the first contact point CP1 and the first separation point SP1. Temperature at the first separation point SP1 may be measured by directing the sensor G1 from the monitoring position $s_{G1}$ towards the first separation point SP1 in the drying section DSEC, such that the sensor G1 receives the infrared radiation emitted from the paper web WEB1 entering the first separation point SP1 in machine direction $DIR_{MD}$. Temperature at the first contact point CP1 may be measured by directing the sensor G1 from the monitoring position $s_{G1}$ towards the first contact point CP1 on the press section PSEC, such that the sensor G1 receives the infrared radiation emitted from the paper web WEB1 exiting the first contact point CP1 in machine direction $DIR_{MD}$.

Figure 8:
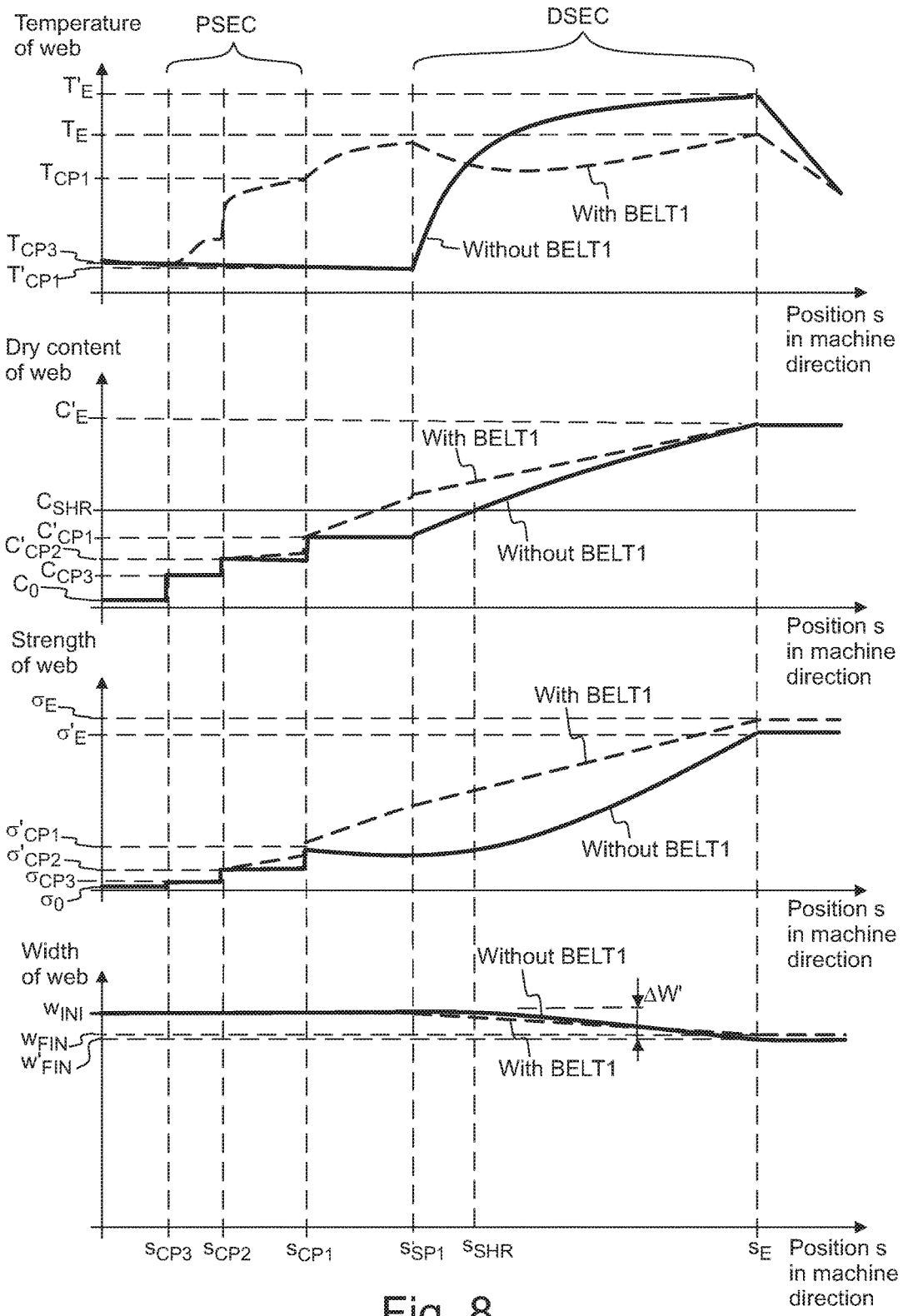
FIG. 8 illustrates, by way of an example, comparative data (with or without a heated, thermally conductive belt) of process parameters and parameter values as a function of position in machine direction in a manufacturing process of a paper suitable for use as a support layer of a release liner.

FIG. 8 illustrates, by way of example, comparative data of the longitudinal temperature distribution of the paper web WEB1, the dry content of the paper web WEB1 at different positions of the web, the tensile strength of the paper web WEB1 at different positions of the web, and the width of the web WEB1 at different longitudinal positions when the web propagates via the press section PSEC, via the support section SSEC, and via the drying section DSEC. The data is shown by two graphs, the dashed line representing a paper manufactured with a heated, thermally conductive metal belt BELT1 in the support section SSEC between positions $s_{CP1}$ and $s_{SP1}$ and the continuous line representing a paper manufactured without the belt BELT1.

The uppermost pair of curves of FIG. 8 show the temperature of the web WEB1 as the function of the longitudinal position s in the machine direction $DIR_{MD}$. The second pair of curves from the top of FIG. 8 shows the dry content of the web as the function of the position s. The third pair curves from the top of FIG. 8 shows the tensile strength of the web of the position s. The lowermost pair of curves of FIG. 8 shows the width of the web WEB1 as the function of the position s.

Referring to the uppermost curve of FIG. 8, the web WEB1 may have a temperature $T_{CP1}$ at the position $s_{CP1}$. with a belt BELT1. The web WEB1 may have a temperature $T'_{CP1}$ at the position $s_{CP1}$. without a belt BELT1. The temperature $T_{CP1}$ may be higher than temperature $T'_{CP1}$. The web WEB1 may have a temperature $T_E$ at the position $s_{CP1}$ with a belt BELT1. The web WEB1 may have a temperature $T'_E$ at the position $s_{CP1}$ without a belt BELT1. The temperature $T'_E$ may be higher than temperature $T_E$. The web WEB1 may have a temperature $T_{SP1}$ at the position $s_{SP1}$, i.e. at the separation point SP1. The web WEB1 may have a temperature $T_E$ at the position $s_E$, i.e. at the end of the drying section. The temperature of the paper web WEB1 may be substantially lower in the support section SSEC between positions $s_{CP1}$ and $s_{SP1}$, than with a metal belt. The temperature difference $T_{SP1}$-$T_{CP1}$ may be close to 0° C. without a belt BELT1. The temperature difference $T_{CP1}$-$T_{CP3}$ in the press section PSEC may be close to 0° C. without a belt BELT1. The temperature difference at position $s_{SP1}$, when compared between situations with and without belt BELT1, may be noticeable. In the drying section DSEC, the area below the temperature graph without belt BELT1 may be larger, when compared to the area below the temperature graph with belt BELT1. Substantially larger amounts of energy may be needed for drying the paper web without a belt BELT1.

Referring to the curve second from the top of FIG. 8. Without a belt BELT1, the dry content $C'_{CP2}$ and dry content $C'_{CP1}$ of the paper web WEB1 may be lower at positions $s_{CP2}$ and $s_{SP1}$, respectively, than with belt BELT1. A dry content $C_{SHR}$ denotes a dry content of the paper web WEB1, wherein the shrinkage of the paper web WEB1 in cross direction begins. With a belt BELT1, the dry content $C_{SHR}$ of the paper web WEB1 may be reached in the support section SSEC between positions $s_{SP1}$ and $s_{SP1}$. Without a belt BELT1, the dry content $C_{SHR}$ of the paper web is reached later, at a position $s_{SHR}$ in the drying section DSEC.

Referring to the curve third from the top of FIG. 8, the tensile strength of the web WEB1 may be increased with the belt BELT1. Without a belt BELT1 in the support section SSEC between positions $s_{CP1}$ and $s_{SP1}$, however, the tensile strength may decrease. The web may have a tensile strength $\sigma_{CP2}$ at the position $s_{CP2}$ with belt BELT1. The web may have a tensile strength $\sigma'_{CP2}$ at the position $s_{CP2}$ with belt BELT1. The tensile strength $\sigma_{CP2}$ may be equal to $\sigma'_{CP2}$. The web may have a tensile strength $\sigma_{CP1}$ at the position $s_{CP1}$ with belt BELT1. The web may have a tensile strength $\sigma'_{CP1}$ at the position $s_{CP1}$ with belt BELT1. The tensile strength $\sigma_{CP1}$ may be higher than $\sigma'_{CP1}$. The web may have a tensile strength $\sigma_E$ at the position $s_E$ with belt BELT1. The web may have a tensile strength $\sigma'_E$ at the position $s_E$ without belt BELT1. While the tensile strength without a belt BELT1 may increase in the drying section DSEC, the tensile strength $\sigma_E$ at the position $s_E$ with the belt BELT1 may higher than the tensile strength $\sigma'_E$ at the position $s_E$ without the belt BELT1.

The lowermost curve of FIG. 8 shows evolution of the width of the web WEB1 with and without a belt BELT1. The web WEB1 entering the first nip of the press section may have an initial width $w_{INI}$ at the position $s_{CP3}$. With a belt BELT1, the width of the paper web WEB1 may begin to reduce at the position $s_{SP1}$, after a dry content $C_{SHR}$ has been reached. Without a belt BELT1, the width of the paper web WEB1 may begin to reduce at the position $s_{SHR}$ in the drying section DSEC, after a dry content $C_{SHR}$ has been reached. The width of the paper roll at the reeling section, after the drying section DSEC, may have a final width $w_{FIN}$ at the position $s_E$ with belt BELT1. The width of the paper roll at the reeling section, after the drying section DSEC, may have a final width $w'_{FIN}$ at the position $s_E$ without belt BELT1. The width $w'_{FIN}$ may be less than the width $w_{FIN}$. The difference between $w'_{FIN}$ and $w_{FIN}$, when compared to $w_{FIN}$, may be equal to or less than 20%.

The above-described method may be used for manufacturing paper suitable for use as a support layer of a release liner. The method may comprise forming a paper web WEB1 from pulp slurry, reducing moisture content of the paper web WEB1 by a press section PSEC, supporting the paper web WEB1 by a belt BELT1 across a distance D1 from a first contact point CP1 in the press section PSEC to a first separation point SP1 on a drying section DSEC, and drying the paper web WEB1 to form paper, and heating the paper web WEB1 when supported by said belt such that the temperature of the paper web WEB1 is in the range of 56 to 99° C. at the first separation point SP1, and the dry content of the paper web WEB1 is equal to or higher than 40 wt.-% at the first separation point SP1.

The above-described method may be used for manufacturing paper suitable for use as a support layer of a release liner. The method may comprise forming a paper web WEB1 from pulp slurry, reducing moisture content of the paper web WEB1 by a press section PSEC, supporting the paper web WEB1 by a belt BELT1 across a distance D1 from a first contact point CP1 in the press section PSEC to a first separation point SP1 on a drying section DSEC, and drying the paper web WEB1 to form paper, and heating the paper web WEB1 such that the temperature profile of the paper web WEB1 in machine direction $DIR_{MD}$ is non-decreasing between a second contact point CP2 in the press section PSEC where the paper web WEB1 first contacts with the belt BELT1 and the separation point SP1 in the drying section DSEC.

In the method, the temperature of the paper web between the first contact point CP1 and the first separation point SP1 may be in the range of 56 to 99° C., preferably in the range of 60 to 99° C. The temperature between the first contact point CP1 and the first separation point SP1 may be the maximum temperature. The method may further comprise heating the paper web WEB1 when supported by said belt such that the temperature of the paper web WEB1 is in the range of 56 to 99° C. at the first contact point CP1, preferably in the range of 60 to 99° C. The method may further comprise heating the paper web WEB1 such that the temperature of the paper web WEB1 is in the range of 56 to 99° C., preferably in the range of 60 to 99° C., after a second contact point CP2, where the paper web WEB1 first contacts with the belt BELT1. In the method, the temperature of the paper web WEB1 is less than 60° C. at the first nip of the press section PSEC, the first nip being defined by a third contact point CP3. The method may thus further comprise heating the paper web WEB1 such that the temperature profile of the paper web WEB1 is non-decreasing between the second contact point CP2 of the press section PSEC and the separation point SP1 in the drying section DSEC, or between the first press nip defined by the third contact point CP3 of the press section PSEC and the first separation point SP1 in the drying section DSEC.

The temperature profile of the paper web WEB1 refers to a temperature difference between two or more positions $s_{CP3}$, $s_{CP2}$, $s_{CP1}$, $s_{SP1}$, $s_E$ of the paper web WEB1 in the machine direction $DIR_{MD}$ of the paper machine. The temperature profile of the paper web WEB1 may be determined from temperature information obtained from two or more positions $s_{CP3}$, $s_{CP2}$, $s_{CP1}$, $s_{SP1}$, $s_E$ on the paper machine by one or more temperature sensors G0, G1, G2, G3, G4. A temperature sensor may be arranged to measure the temperature of the paper web at a sensor monitoring position. The sensor monitoring position may be a position between two positions selected from $s_{CP3}$, $s_{CP2}$, $s_{CP1}$, $s_{SP1}$, $s_E$. At positions $s_{CP3}$, $s_{CP2}$, $s_{CP1}$, $s_{SP1}$, $s_E$, the paper web WEB1 may have a temperature $T_{CP3}$, $T_{CP2}$, $T_{CP1}$, $T_{SP1}$, $T_E$. respectively. For example, referring to FIG. 2 and FIG. 7, the temperature sensors G1 and G2 may be arranged such that the temperature sensor G1 is arranged between the first contact point CP1 in the press section PSEC and the first separation point SP1 in the drying section DSEC. The temperature sensor G1 provides first temperature information of the paper web between points $s_{CP1}$ and $s_{SP1}$. The first temperature information refers to $T_{G1}$. The temperature sensor G2 is arranged between the second contact point CP2 and the first contact point CP1 in the press section PSEC. The temperature sensor G2 provides second temperature information of the paper web between points $s_{CP2}$ and $s_{CP1}$. The second temperature information refers to $T_{G2}$. When the first temperature information $T_{G1}$ is equal to or higher than second temperature information $T_{G2}$, the temperature difference between $T_{CP2}$ and $T_{SP1}$ is non-decreasing, and therefore the temperature profile of the paper web WEB1 is non-decreasing between the second contact point CP2 of the press section PSEC and the separation point SP1 in the drying section DSEC. When determining a non-decreasing temperature profile between the first contact point CP1 in the press section PSEC and the first separation point SP1, the non-decreasing temperature profile is due to the thermally conductive belt BELT1. In other words, the temperature profile of the paper web WEB1 referring to a temperature difference between $T_{CP2}$ and $T_{SP1}$ is measured when a heating element HEAT1 is not used. If a heating element HEAT1, such as a steam box, is positioned between the third contact point CP3 and the second contact point CP2 in the press section PSEC, the heating element HEAT1 is turned off before determining the temperature profile between the first contact point CP1 in the press section PSEC and the first separation point SP1.

An advantage provided by the above-described method is, that on a paper machine having rolls with given axial length, the final width of paper formed from a paper web having an initial width may be increased. In particular, the final width of the paper formed from the paper web may be increased without increasing the axial length of the rolls on the paper machine. Therefore, use of a thermally conductive belt in combination with heating as above-described, provides means for improving the manufacturing process of paper suitable for use as a support paper of a release liner. A paper roll obtained according to the method has increased width, which is beneficial. The increased width may be used, for example, when slitting (trimming) the paper roll to obtain paper rolls having various widths.

Further uses are, for example use of a belt in combination with heating to reduce tension of the paper web in the machine direction between the press section and the drying section, use of a belt in combination with heating to reduce shrinkage of the paper web in the cross direction perpendicular to the machine direction and use of a belt in combination with heating and chemical pulp having a Schopper Riegler (SR) Freeness value in the range of 35 to 50 after refining.

EXAMPLES

Below are presented example cases demonstrating effects obtained by a method as described above. Chemical pulp was used in the examples. The example cases are based on data obtained with a belt assembly, which has been compared to data obtained on the same paper machine prior to installing said belt assembly.

Example 1—Reduced Refining Combined with a Heated Metal Belt

Test runs were made before and after installation of a belt assembly on a paper machine. With a belt assembly, pulp slurry having a 10% reduction in the refining level was used, when compared to test runs without the belt assembly. The 10% reduction was measured as difference between Schopper-Riegler (SR) Freeness test values. For example, if the Schopper-Riegler (SR) Freeness test value after refining in a process without the metal assembly was 40, a 10% reduction in the refining level would mean a Schopper-Riegler (SR) Freeness test value of 36. A paper web was formed from the pulp slurry and transferred to the press section of the paper machine at a velocity $v_{WEB}$, the velocity being above 1000 m/min. The press section comprised two or more press nips. When using the belt assembly, the paper web was heated to a temperature of at least 20° C. higher in the press section compared to the paper web temperature before the press section. The moisture content of the paper web was reduced by pressing in the press section. After pressing, the paper web was supported by a belt assembly between the press section and the drying section, the belt assembly comprising a heat conductive metal belt, surrounding two rolls, the rolls guiding and holding the metal belt tight. The tension to the paper web was reduced by adapting the circumferential velocity of the tension providing rolls in the press section and the drying section, the circumferential velocity difference of the rolls being in the range of 2 to 3%. While supported on the metal belt, the temperature of the paper was in the range of 70 to 85° C. The dry content of the paper web was measured at the beginning of the drying section, where the paper web was detached from the belt at the separation point SP1. An increase of the paper web dry content in the range of 10 to 20 wt.-% was observed, compared to dry content values measured at the same point prior to the use of the metal belt. For example, if in a measurement prior to the use of the metal belt, the paper web dry content was 39 wt.-%, in a measurement obtained with the metal belt, the paper web dry content was in the range of 43 wt.-% to 47 wt.-%. Due to the improvements in the manufacturing process for release liner with the belt assembly, an increase of up to 16% in the paper web speed $v_{WEB}$ was possible.

Example 2—Effect to Production Capacity

Table 1 below illustrates an example case the average changes in the amounts of water in the paper machine before and after installation of a belt assembly. The values in the column "With belt assembly" refers to change in percentage units, when compared to the values in the column "Prior to belt assembly". A comparative index value of 100 has been given to the data in the column "With belt assembly", for which the changed values in the column "With belt assembly" have been compared to.

TABLE 1

Comparative data of the changes in the dewatering amounts in the process before and after use of a belt assembly.

| | Prior to belt assembly | With belt assembly |
|---|---|---|
| water to press section 1000 kg/day | 100 | 122 |
| water after press section 1000 kg/day | 100 | 99 |
| reduction of water 1000 kg/day | 100 | 135 |
| reduction of water per tons of paper | 100 | 111 |

As can be seen from the table, the amount of water after press section (1000 kg/day) is substantially the same, or 1% less, even though with the belt assembly, an increase of up to 16% in the paper web speed $v_{WEB}$ was possible. This is evident also from the 22% increase in the amount of water to press section (1000 kg/day), which both reflect the increased manufacturing capacity having a higher efficiency. The reduction of water (1000 kg/day) has improved ca. 35% due to the reduced refining and belt assembly, and ca. 11% more water can be removed, when calculated per tons of paper manufactured. The results demonstrate, that heating the paper web at the press section and while supporting on a belt, increases the reduction of the moisture content of the paper web and produces a paper web having a higher dry content already after the press section, before the paper web enters the drying section.

Example 3—Quality of Paper Manufactured with and without a Belt Assembly

Table 2 below illustrates the effect of heating and supporting the paper web on a heat conductive metal belt on a paper machine in an example case. The paper web shrinkage percentage has been when measured as a relative difference between the width of the paper web at the first nip of the press section and the width of the paper roll at the reeling section. The paper web tension has been measured by rotating a roll CYL3 at the first contact point CP1 having a first velocity $v_{CYL3}$ and a roll CYL5 at the first separation point SP1 having a second velocity $v_{CYL5}$, the web tension referring to the difference $\Delta v_{WEB}$ between the second velocity $v_{CYL5}$ and the first velocity $v_{CYL3}$, wherein $\Delta v_{WEB}=(v_{CYL5}-v_{CYL3})/v_{CYL3}*100\%$. The first paper web temperature refers to a paper web temperature measured on a press section before the paper web first contacts with the belt at the second contact point CP2, and after a first nip of the press section, the first nip being defined by a third contact point CP3. The second paper web temperature refers to a paper web temperature measured while supported on the belt, before the paper web enters the drying section at a first separation point SP1. The dry content refers to the dry content of the paper web measured at a first separation point SP1, which is the same point as used for measuring the second web temperature. The paper web velocity $v_{WEB}$ has been given in relative velocity values. The velocity of the paper web when manufacturing paper prior to belt assembly has been given a value of 100%. The higher velocity of the paper web with belt assembly has been given as a difference in percentages to the velocity prior to belt assembly. The values in the column "With belt assembly" therefore refer to values obtained in a method having a 16% higher paper web velocity when compared to values in the column "Prior to belt assembly".

TABLE 2

Comparative data of the effect of heating and supporting the paper web on a paper machine process with a heat conductive metal belt and without a heat conductive metal belt.

| | Prior to belt assembly | With belt assembly |
|---|---|---|
| Paper web shrinkage percentage | 5.0-5.5% | 4.0-4.2% |
| Paper web tension | 4.0-4.5% | 2.8-3.2% |
| first paper web temperature | 45-55° C. | 45-55° C. |
| second paper web temperature | 45-55° C. | 70-85° C. |
| Dry content of the paper web (on SP1) | 38-39% | 40-48% |
| Paper web velocity $v_{WEB}$ (relative velocity) | 100% | 116% |

The results in Table 2 demonstrate, that the shrinkage of the paper web with a belt assembly, when compared to the shrinkage of the paper web prior to a belt assembly, has been reduced by at least 20%. The shrinkage of the paper web with a belt assembly, when compared to the shrinkage of the paper web prior to a belt assembly, has been reduced in the range of 20 to 24%. Prior to a belt assembly, the shrinkage of the paper web has been in the range of 5 to 5.5%. In a method for manufacturing paper suitable for use as a support layer of a release liner comprising heating and supporting the paper web by a belt, enables the shrinkage of the paper web in the cross direction is less than 6%, preferably less than 5%. The shrinkage of the paper web with a belt assembly, measured as a difference between the width of the paper web at the first nip of the press section and the width of the paper roll at the reeling section, has been in the range of 4 to 4.2%. When adapting the obtained results to the increase in paper web velocity $v_{WEB}$, with the belt assembly, a shrinkage of the paper web equal to or less than 4% may be obtainable, when reducing the paper web velocity $v_{WEB}$.

The results in Table 2 further demonstrate, that the paper web tension has been reduced by 30% in a method using a paper web with a belt assembly, when compared to a situation prior to a belt assembly. The difference between the second velocity $v_{CYL5}$ and the first velocity $v_{CYL3}$ is less than 4%, preferably less than 3.5% of the first velocity $v_{CYL3}$. The web tension of the paper web with a belt assembly, measured between the first contact point CP1 and the first separation point SP1, has been in the range of 2.8 to 3.2%.

The results in Table 2 further demonstrate, that the dry content of the paper web at the first separation point SP1 has been increased in the range of 3 to 26% in a method using a paper web with a belt assembly, when compared to a situation prior to a belt assembly. By increasing the first temperature of the paper web on the press section, such that the temperature of the paper web is equal to or higher than 60° C. at the first separation point, the dry content of the paper web was at least 40 wt.-%, in the range of 40 to 48% at the first separation point. In comparison to situation prior to a belt assembly, the average dry content of the paper web at the first separation point SP1 is higher when manufacturing paper with the belt assembly. By heating the paper web when supported by the belt, and by further heating the paper web after a first nip of the press section before the paper web first contacts with the belt, such that the temperature of the paper web is in the range of 60 to 99° C., the dry content of the paper web may be increased even further.

The results in Table 2 further demonstrate, that with the belt assembly and heating, the velocity of the paper web $v_{WEB}$ may be increased, while at the same time reducing the shrinkage in the cross direction, and reducing the draw of the paper web in machine direction. The increase in temperature further has enables higher dry content of the paper web before the paper is drawn, which has further improved the paper surface density. In spite of an increase equal to or higher than 10% in the paper web velocity $v_{WEB}$ with a belt assembly, the surface density of the paper formed from the paper web has increased up to 47%, when compared to a situation prior to a belt assembly. At the same time, the tear strength in machine direction and cross direction has not decreased.

As a further example of the effect of heating the paper web when supported by a belt such that the temperature of the paper web is in the range of 60 to 99° C., the measured Bekk porosity of a paper having a grammage equal to 45 g/m$^2$ and thickness in the range of 43 to 46 micrometers, was equal to or less than 50 s/10 ml prior to metal belt. When measuring the Bekk porosity of a paper having a grammage equal to 45 g/m$^2$ and thickness in the range of 43 to 46 micrometers manufactured with a belt assembly as described above, the values were equal to or above 80 s/10 ml. The Bekk porosity of a paper having a grammage equal to 45 g/m$^2$ was typically in the range of 80 to 94 s/10 ml.

The invention has been described with the aid of illustrations and examples. The method or any product obtained by the method is not limited solely to the above presented embodiments, but may be modified within the scope of the appended claims. The features recited in the text above, including embodiments and examples, and as presented in the following dependent claims, are mutually freely combinable unless otherwise explicitly stated.

We claim:

1. A method for manufacturing paper suitable for use as a support layer of a release liner, the method comprising:

forming a paper web from pulp slurry, conveying the paper web to a press section, reducing moisture content of the paper web by the press section, such that after the press section, the paper web has a dry content level in the range of 15 to 35 wt.-%, moving the paper web from the press section to a drying section by supporting the paper web by a belt across a distance from a first contact point in the press section denoting the end of the press section to a first separation point denoting the beginning of the drying section and wherein the paper web is detached from the belt, wherein the press section is positioned before the drying section in the travel direction of the paper web, the first contact point defining a point where the belt supporting the paper web is detached from a roll, and drying the paper web to form paper, and heating the paper web when supported by said belt such that the temperature of the paper web is in the range of 56 to 99° C. at the first separation point, and the dry content of the paper web is equal to or higher than 40 wt.-% at the first separation point.

2. The method according to claim 1, further comprising heating the paper web such that the temperature profile of the paper web is non-decreasing in machine direction between a second contact point of the press section positioned before the first contact point in the press section in the travel direction of the paper web, wherein the belt first contacts the paper web and the separation point in the drying section.

3. The method according to claim 2, further comprising heating the paper web such that the temperature of the paper web is in the range of 56 to 99° C. at the second contact point where the paper web first contacts with the belt.

4. The method according to claim 1, wherein the maximum temperature of the paper web between the first contact point and the first separation point is in the range of 56 to 99° C.

5. The method according to claim 1, further comprising heating the paper web when supported by said belt such that the temperature of the paper web is in the range of 56 to 99° C. at the first contact point.

6. The method according to claim 1, wherein the temperature of the paper web is less than 56° C. at a first nip of the press section, the first nip being defined by a third contact point, denoting the inlet point of the paper web to the press section in the travel direction of the paper web.

7. The method according to claim 1, further comprising reducing the moisture content of the paper web by pressing the paper web at two or more nips defined by contact points in the press section.

8. The method according to claim 1, said paper having a grammage equal to or less than 78 g/m$^2$.

9. The method according to claim 1, further comprising forming said pulp slurry from chemical pulp having a Schopper Riegler Freeness value equal to or less than 50 after refining.

10. The method according to claim 1, wherein the belt is a thermally conductive belt supporting the paper web, the material of the belt having a thermal conductivity equal to or higher than 15 Wm-$^1$ K-$^1$.

11. The method according to claim 1, wherein the distance is equal to or more than 10 millimeters.

12. The method according to claim 1, further comprising rotating a roll at the first contact point at a first velocity, and rotating a roll at the first separation point at a second velocity higher than the first velocity, such that the difference between the second velocity and the first velocity is less than 4% of the first velocity.

13. The method according to claim 1, wherein the first velocity or the second velocity is equal to the velocity of the paper web, the paper web having a velocity of equal to or higher than 600 meters per minute in machine direction.

14. The method according to claim 1, wherein at the first separation point the dry content of the paper web is in the range of 40 wt.-% to 55 wt.-%.

15. The method according to claim 1, wherein shrinkage of the paper web in the cross direction is less than 6% when measured as a relative shrinkage $\Delta w/w_{INI}$ between the width of the paper web at a first nip of the press section and the width of the paper roll at a reeling section.

16. The method according to claim 1, further comprising applying a primer layer on the formed paper.

17. The method according to claim 1, further comprising calendering the paper off-line or on-line to a thickness of less than 100 micrometers.

18. The method according to claim 1, said paper being suitable to be coated with a silicone based release coating in a quantity of equal to or less than 2 g/m$^2$ per side.

19. A paper obtained according to a method comprising:

forming a paper web from pulp slurry, conveying the paper web to a press section, reducing moisture content of the paper web by the press section, such that after the press section, the paper web has a dry content level in the range of 15 to 35 wt.-%, moving the paper web from the press section to a drying section by supporting the paper web by a belt across a distance from a first contact point in the press section denoting the end of the press section to a first separation point denoting the beginning of the drying section and wherein the paper web is detached from the belt, wherein the press section is positioned before the drying section in the travel direction of the paper web, the first contact point defining a point where the belt supporting the paper web is detached from a roll, drying the paper web to form paper, heating the paper web when supported by said belt such that the temperature of the paper web is in the range of 56 to 99° C. at the first separation point, and the dry content of the paper web is equal to or higher than 40 wt.-% at the first separation point, rotating a roll at the first contact point at a first velocity, and rotating a roll at the first separation point at a second velocity higher than the first velocity, such that the difference between the second velocity and the first velocity is less than 4% of the first velocity;

wherein a web tension of the paper web measured between the first contact point and the first separation point is 2.8 to 3.2%; and wherein the paper web shrinks by less than 5% in a cross direction.

20. A release coating for labelling comprising the paper of claim 19.

* * * * *